US008351809B2

(12) United States Patent
Takemura

(10) Patent No.: US 8,351,809 B2
(45) Date of Patent: Jan. 8, 2013

(54) CONTROL APPARATUS, PROGRAM, RECORDING MEDIUM, AND IMAGE FORMING SYSTEM

(75) Inventor: Taichi Takemura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 342 days.

(21) Appl. No.: 12/695,223

(22) Filed: Jan. 28, 2010

(65) Prior Publication Data

US 2010/0196035 A1 Aug. 5, 2010

(30) Foreign Application Priority Data

Jan. 30, 2009 (JP) ..... 2009-020223

(51) Int. Cl.
*G03G 15/08* (2006.01)
*G03G 15/00* (2006.01)

(52) U.S. Cl. ..... 399/53; 399/45

(58) Field of Classification Search ..... 399/39, 399/45, 53

See application file for complete search history.

(56) References Cited

U.S. PATENT DOCUMENTS

| | | | | |
|---|---|---|---|---|
| 7,502,582 | B2 * | 3/2009 | Ng et al. | 399/296 |
| 2005/0135851 | A1 | 6/2005 | Ng et al. | 399/341 |
| 2006/0114481 | A1 * | 6/2006 | Moore | 358/1.9 |
| 2007/0263242 | A1 | 11/2007 | Takahashi | |

FOREIGN PATENT DOCUMENTS

| | | | |
|---|---|---|---|
| EP | 2 090 938 | A1 | 8/2009 |
| JP | 2002-072613 | | 3/2002 |
| JP | 2007041391 | A | 2/2007 |
| JP | 2007301911 | A | 11/2007 |

OTHER PUBLICATIONS

European Search Report issued in counterpart application No. 10151947.8 dated Jul. 20, 2010—6 pages.

Office Action which issued on Feb. 29, 2012, in counterpart CN application No. 201010107862.6.

Office Action—Korean Patent Appln. No. 2010-7918, dated Jun. 19, 2012, Korean Patent Office.

* cited by examiner

*Primary Examiner* — David Gray
*Assistant Examiner* — Gregory H Curran
(74) *Attorney, Agent, or Firm* — Fitzpatrick, Cella, Harper & Scinto

(57) ABSTRACT

When glossiness in an area designated by a user was adjusted, the glossiness adjustment was achieved by exchanging a plurality of toners having different glass transition points. Thus, the user was required to select an appropriate toner when the glossiness in the area designated by the user was adjusted. Further, the user took some time or effort to set the selected toner every glossiness adjustment. In the present invention, how to adjust the glossiness in the area designated by the user is obtained as mode information and on the basis of the obtained mode, control is effected so that a transparent image is selectively formed in the area designated by the user or an image formable area except for the area designated by the user.

7 Claims, 23 Drawing Sheets

PROCESSING FOR LOW GLOSSY PAPER

PROCESSING FOR LOW GLOSSY PAPER (a)

(b)

LOW →

| COLUMN ↓ | 1 | 2 | 3 | 4 | 5 | 6 | 7 | 8 | 9 | 10 |
|---|---|---|---|---|---|---|---|---|---|---|
| 1 | 0, | 0, | 0, | 0, | 0, | 0, | 0, | 0, | 0, | 0 |
| 2 | 25, | 25, | 25, | 25, | 25, | 25, | 25, | 25, | 25, | 25 |
| 3 | 50, | 50, | 50, | 50, | 50, | 50, | 50, | 50, | 50, | 50 |
| 4 | 100, | 100, | 100, | 100, | 100, | 100, | 100, | 100, | 100, | 100 |
| 5 | 100, | 100, | 100, | 100, | 100, | 100, | 100, | 100, | 100, | 100 |
| 6 | 100, | 100, | 100, | 100, | 75, | 75, | 75, | 75, | 75, | 75 |
| 7 | 100, | 100, | 100, | 100, | 75, | 75, | 75, | 75, | 75, | 75 |
| 8 | 100, | 100, | 75, | 75, | 75, | 75, | 50, | 50, | 50, | 50 |
| 9 | 100, | 100, | 75, | 75, | 75, | 75, | 50, | 50, | 50, | 50 |
| 10 | 100, | 100, | 75, | 75, | 50, | 50, | 50, | 50, | 50, | 50 |
| 11 | 100, | 100, | 75, | 75, | 50, | 50, | 25, | 25, | 25, | 25 |
| 12 | 100, | 100, | 75, | 75, | 75, | 75, | 75, | 75, | 100, | 100 |
| 13 | 100, | 100, | 75, | 75, | 75, | 75, | 75, | 75, | 100, | 100 |

IMAGE DATA (%)

(a) APPLY TONER TO C

LOW →

| COLUMN | 1 | 2 | 3 | 4 | 5 | 6 | 7 | 8 | 9 | 10 |
|---|---|---|---|---|---|---|---|---|---|---|
| 1 | 37 | 37 | 37 | 37 | 37 | 37 | 37 | 37 | 37 | 37 |
| 2 | 36 | 36 | 36 | 36 | 36 | 36 | 36 | 36 | 36 | 36 |
| 3 | 34 | 34 | 34 | 34 | 34 | 34 | 34 | 34 | 34 | 34 |
| 4 | 29 | 29 | 29 | 29 | 29 | 29 | 29 | 29 | 29 | 29 |
| 5 | 29 | 29 | 29 | 49 | 49 | 49 | 49 | 49 | 49 | 29 |
| 6 | 29 | 29 | 29 | 49 | 34 | 34 | 34 | 34 | 34 | 31 |
| 7 | 29 | 29 | 29 | 49 | 34 | 34 | 34 | 34 | 34 | 31 |
| 8 | 29 | 29 | 31 | 34 | 34 | 34 | 20 | 20 | 20 | 30 |
| 9 | 29 | 29 | 31 | 34 | 34 | 34 | 20 | 20 | 20 | 30 |
| 10 | 29 | 29 | 31 | 34 | 20 | 20 | 9 | 9 | 9 | 36 |
| 11 | 29 | 29 | 31 | 34 | 20 | 20 | 9 | 9 | 9 | 36 |
| 12 | 29 | 29 | 31 | 34 | 34 | 34 | 34 | 34 | 49 | 29 |
| 13 | 29 | 29 | 31 | 31 | 31 | 31 | 31 | 31 | 29 | 29 |

GLOSSINESS (%)

(b) APPLY TONER TO B

LOW →

| COLUMN | 1 | 2 | 3 | 4 | 5 | 6 | 7 | 8 | 9 | 10 |
|---|---|---|---|---|---|---|---|---|---|---|
| 1 | 6 | 6 | 6 | 6 | 6 | 6 | 6 | 6 | 6 | 6 |
| 2 | 9 | 9 | 9 | 9 | 9 | 9 | 9 | 9 | 9 | 9 |
| 3 | 25 | 25 | 25 | 25 | 25 | 25 | 25 | 25 | 25 | 25 |
| 4 | 49 | 49 | 49 | 49 | 49 | 49 | 49 | 49 | 49 | 49 |
| 5 | 49 | 49 | 49 | 29 | 29 | 29 | 29 | 29 | 29 | 49 |
| 6 | 49 | 49 | 49 | 29 | 31 | 31 | 31 | 31 | 31 | 34 |
| 7 | 49 | 49 | 49 | 29 | 31 | 31 | 31 | 31 | 31 | 34 |
| 8 | 49 | 49 | 34 | 31 | 31 | 31 | 30 | 30 | 30 | 20 |
| 9 | 49 | 49 | 34 | 31 | 31 | 31 | 30 | 30 | 30 | 20 |
| 10 | 49 | 49 | 34 | 31 | 30 | 30 | 36 | 36 | 36 | 9 |
| 11 | 49 | 49 | 34 | 31 | 30 | 30 | 36 | 36 | 36 | 9 |
| 12 | 49 | 49 | 34 | 31 | 31 | 31 | 31 | 31 | 29 | 49 |
| 13 | 49 | 49 | 34 | 34 | 34 | 34 | 34 | 34 | 49 | 49 |

GLOSSINESS (%)

FIG.20

CONTROL APPARATUS, PROGRAM, RECORDING MEDIUM, AND IMAGE FORMING SYSTEM

FIELD OF THE INVENTION AND RELATED ART

The present invention relates to a control apparatus for controlling an image forming system for forming a color image and a transparent image on a sheet, a program for causing an information processing apparatus or an information processing system to function as the control apparatus, a recording medium storing the program, and the image forming system.

In a printing market, in order to add higher value to a print, there is a demand to increase or decrease glossiness of the sheet at a designated portion compared with that of the sheet at an adjacent portion. In order to meet this demand, Japanese Laid-Open Patent Application (JP-A) 2002-72613 discloses a method in which the glossiness at the designated portion is adjusted by utilizing two types of transparent toners different in glass transition points.

An image forming apparatus described in JP-A 2002-72613 includes fine developing devices. In these developing devices, cyan toner, magenta toner, yellow toner, black toner, and transparent toner are filled, respectively. It has been known that the glossiness in an area in which the toner having a higher glass transition point is fixed is lower than the glossiness in an area in which the toner having a lower glass transition point is fixed when the toners are fixed on the sheet in the same amount. For that reason, in JP-A 2002-72613, in order to increase the glossiness in the designated area, color toner having a higher glass transition point and transparent toner having a lower glass transition point are filled in the associated developing devices. Then, by forming a transparent toner image in the designated area, the glossiness in the area in which the transparent toner image is formed is increased. Further, in order to decrease the glossiness in the designated area, color toner having a lower glass transition point and transparent toner having a higher glass transition point are filled in the associated developing devices. Then, by forming the transparent toner image in the designated area, the glossiness in the area in which the transparent toner image is formed is decreased.

Thus, by using the two types of transparent toners different in glass transition point, the glossiness at the designated portion can be made higher than or lower than that at the adjacent portion.

However, in a constitution in which the two types of transparent toners different in glass transition point, a user was required to replace the transparent toner with the other transparent toner in the image forming apparatus every time the case where the glossiness in the designated area is increased and the case where the glossiness in the designated area is decreased are switched to each other.

SUMMARY OF THE INVENTION

A principal object of the present invention is to provide a control apparatus capable of increasing and decreasing glossiness in an area designated by a user compared with glossiness in an adjacent area by forming a transparent image in an image formable area obtained by an obtaining means or in an image formable area except for the obtained area.

Another object of the present invention is to provide a program for causing an information processing apparatus or system as the control apparatus, a recording medium storing the program, and an image forming system including the control apparatus.

According to an aspect of the present invention, there is provided a control apparatus for controlling an image forming system capable of forming a transparent image, for adjusting glossiness by using transparent toner, on a part of a sheet on which a color image is to be formed, the control apparatus comprising:

area obtaining means for obtaining an area in which glossiness of at least a part of the color image to be formed on the sheet is to be adjusted;

mode obtaining means for obtaining a mode selected from a plurality of modes including a mode in which the glossiness in the area obtained by the area obtaining means is relatively higher than that in another area and including a mode in which the glossiness in the area obtained by the area obtaining means is relatively lower than that in another area; and control means for controlling the image forming system so that the transparent image is selectively formed, depending on the mode obtained by the mode obtaining means, in an image formable area obtained by the area obtaining means or in an image formable area except for the area obtained by the area obtaining means.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 20(*a*) and 20(*b*) are schematic views each showing a matrix for illustrating a data structure in which the density distribution of the color image data is converted into a glossiness distribution.

DETAILED DESCRIPTION OF THE PREFERRED EMBODIMENTS

In the following embodiments, a glossiness representing a degree of gloss was measured by using a handy glossimeter ("PG-1M", mfd. by Nippon Denshoku Industries Co., Ltd.). The measurement was performed in a 60 degree-gloss measurement mode in accordance with JIS Z 8741 (specular glossiness measuring method).

Hereinbelow, the embodiments to which the present invention is applied will be described. However, dimensions, materials, shapes, and relative arrangements of constituent elements described in the following embodiments may be appropriately changed depending on constitutions and various conditions for apparatuses or devices to which the present invention is applied. Therefore, it should be understood that the present invention is not limited to those specifically described in the following embodiments unless otherwise noted specifically.

Embodiment 1

(Hardware Configuration of MFP)

A hardware configuration of an MFP as an example of the image forming apparatus will be described. An MFP 100 is constituted by a controller portion as a control apparatus and a control means, a scanner portion, and the printer portion. The respective portions will be described below in detail. Incidentally, the MFP refers to a multifunction device having a plurality of functions such as a copying function, a printer function, a transfer function of a facsimile machine, and a scanner function.

(Controller Portion)

Figure 1:
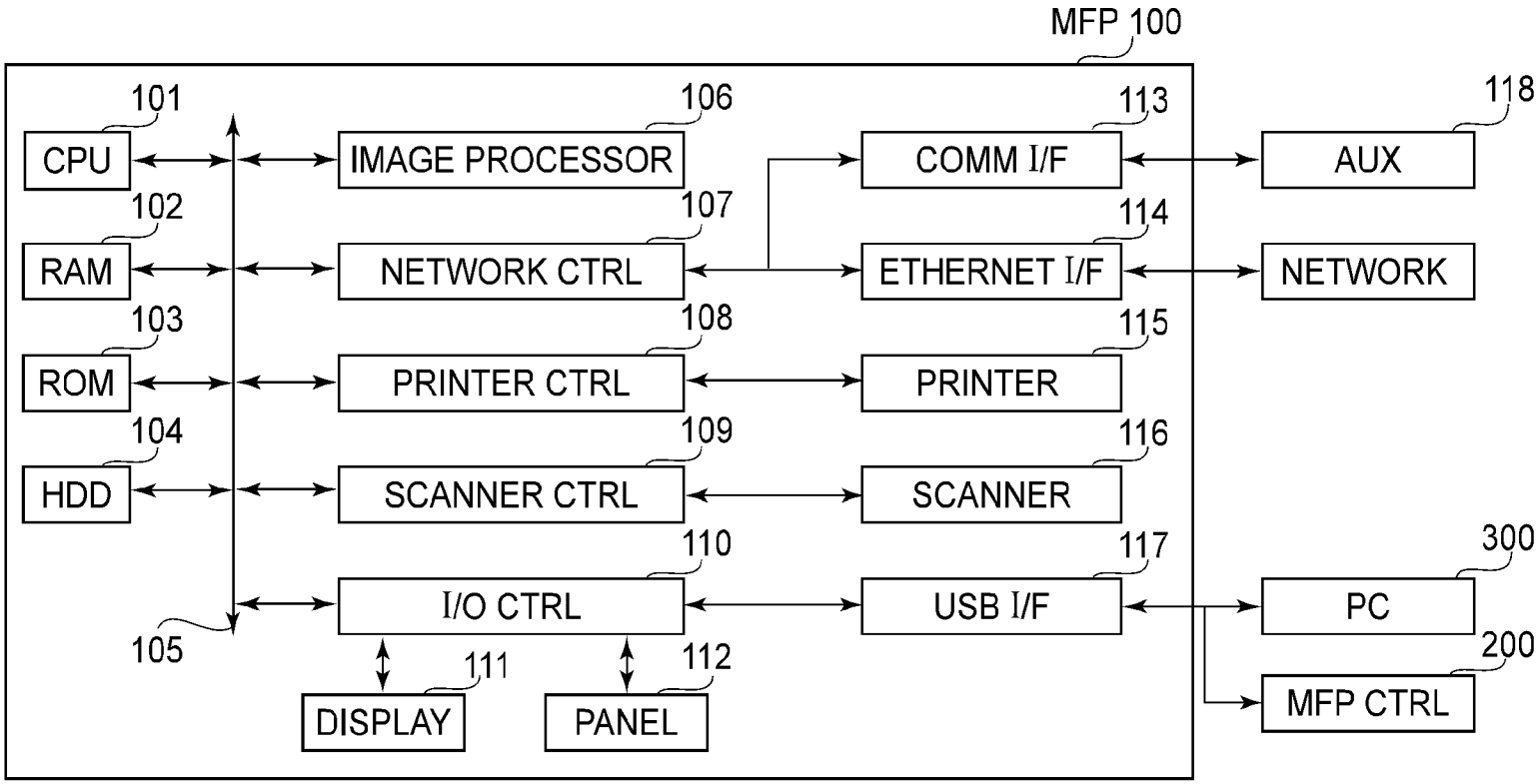
FIG. 1 is a block diagram showing a schematic constitution of an MFP (multifunction peripheral or printer) in an embodiment of the present invention.

FIG. 1 is a block diagram showing an example of the hardware configuration of the MFP 100. A CPU (central processing unit) 101 as the control means, an RAM (random access memory) 102, and an ROM (read only memory) 103 are connected to a bus 105. Similarly, a HDD (hard disk drive) 104, a dedicated image processing circuit 106, a network controller 107, a printer controller 108, a scanner controller 109, and an I/O controller 110 are connected to the bus 105. The various units connected to the bus 105 can communicate with each other through the bus 105.

In such a constitution, the CPU 101 as the control means sends control instructions or the like, through the bus 105, to the HDD 104, the network controller 107, the printer controller 108, the scanner controller 109, and the I/O controller 110. Further, the CPU 101 receives, through the bus 105, a state indicating signal or data such as image data from the HDD 104, the network controller 107, the printer controller 108, the scanner controller 109, and the I/O controller 110. Thus, the CPU 101 can control the various units constituting the MFP 100. Operations of the respective units will be described more specifically.

The CPU 101 and the dedicated image processing circuit 106 expand a program stored in, e.g., the ROM 103 into a primary memory which is called registry present in the CPU 101 or the dedicated image processing circuit 106 and execute the program. The RAM 102 is shared and used as a secondary memory needed during execution of the program by the CPU 101 or the dedicated image processing circuit 106. The HDD 104 having a larger storage capacity than that of the ROM 103 is principally used for storing the image data held in the MFP 100. The network controller 107 is a processing circuit for communicating with external equipment. The network controller 107 modulates and converts signals sent from the CPU 101 into signals in accordance with various standards. In this embodiment, the network controller 107 converts the sent signals into multi-valued signals in accordance with IEEE 803.2 standard and sends the signals to a network through an ethernet I/F 114. Further, the network controller 107 demodulates the multi-valued signals sent from the network through the ethernet I/F 114 and sends the signals to the CPU 101. As a result, the MFP 100 may communicate with an MFP controller 200 as the control apparatus or a PC 300 as the control apparatus through the network. Similarly, the network controller 107 converts a signal sent from the CPU 101 into a signal in accordance with ARCNET (attached resource computer network) standard and sends the signal to an auxiliary device 118 through an auxiliary I/F 114. Further, the network controller 107 demodulates a signal received from the auxiliary device 118 and sends the signal to the CPU 101. As the auxiliary device 118, e.g., a finisher as a post-processing device, a paper deck as an auxiliary sheet feeding device, and the like may be used. Picture data sent from the CPU 101 to a printer portion 115 as an image forming portion through the printer controller 108 is image data. Therefore, when a PDL (page description language) is inputted from the PC 300 to the MFP 100, the CPU 101 and the dedicated image processing circuit execute RIP (raster image processing) in a shared manner. Incidentally, the PDL is a programming language for instructing a picture image to be outputted to the MFP 100. Advantages of the PDL is that graphics can be held as vector data independent of a resolution of the printer and that an amount of data in the case of a simple line image can be made smaller than that of the image data. On the other hand, by using the PDL, the PDL is required to be re-converted into map image data needed during output at the printer portion, so that processing therefore incurs overhead. Such a processing for converting the PDL into the image data is referred to as the RIP. In this way, the image data converted from the PDL by the RIP is sent to the printer portion 115 through the printer controller 108. The printer portion 115 outputs a print on the basis of the received image data. Incidentally, the printer controller 108 controls the printer portion 115 on the basis of the externally inputted image data so that a toner image corresponding to the image data can be fixed on the sheet. The printer controller 108 can control the printer portion 115 on the basis of the image data externally sent through the network controller 107.

The scanner controller 109 controls an original image reading operation of an image sensor provided at a lower portion of an original carriage provided to a scanner portion 116 and an operation of an ADF (automatic document feeder). A user sets an original on the original carriage one by one when the image data of the original is read by the MFP 100. The scanner controller 109 receives original reading instructions and actuates the image sensor provided at the lower portion of the original carriage to scan the original surface, thus obtaining image data of the original set on the original carriage. Further, the user can provide instructions to set a plurality of sheets of the original and to read image data from the plurality of sheets. As a result, the ADF feeds one of the plurality of sheets of the original to the image sensor portion. Then, the ADF feeds one of the plurality of sheets, excluding the sheet which has already been fed to the image sensor portion, to the image sensor portion, thus repeating this operation until the feeding of the plurality of sheets of the original is completed. As a result, it is possible to automatically and successively read the image data from the original set to the ADF. Thus, in the case subjecting a large amount of the original to scanning, it is possible to save the user from placing another one of the plurality of sheets of the original on the original carriage one by one.

In a case where a box mode for storing an image in the HDD 104 provided in the MFP 100 is selected, the scanner controller 109 stores the image data obtained by the scanner portion 116 in the HDD 104. In the case where a copy mode for outputting the image data, obtained by the scanner portion 116, from the printer portion 115, is selected, the scanner controller 109 sends the image data obtained by the scanner portion 116 to the printer controller 108. As a result, the printer controller 108 outputs the received image data to the printer portion 115.

The I/O controller 110 communicate with the PC 300 or the MFP controller 200 through a USB (universal serial bus) I/F 117. Further, the I/O controller 110 is connected to a display 111 as a displaying means and an operation panel as an input means. The CPU 101 can obtain information inputted from the operation panel by the user through the I/O controller 110. Further, the I/O controller 110 displays information selectable by the user or information indicating a state of the MFP 100 on the display 111. On the display 111, a screen into which information on glossiness of the sheet to be used in the MFP 100 is to be input, a screen into which information on an area in which the glossiness is intended to be partly and relatively increased by using transparent toner is to be input, and the like screen are displayed.

The above is the description for the controller portion.

(Scanner Portion)

Figure 2:
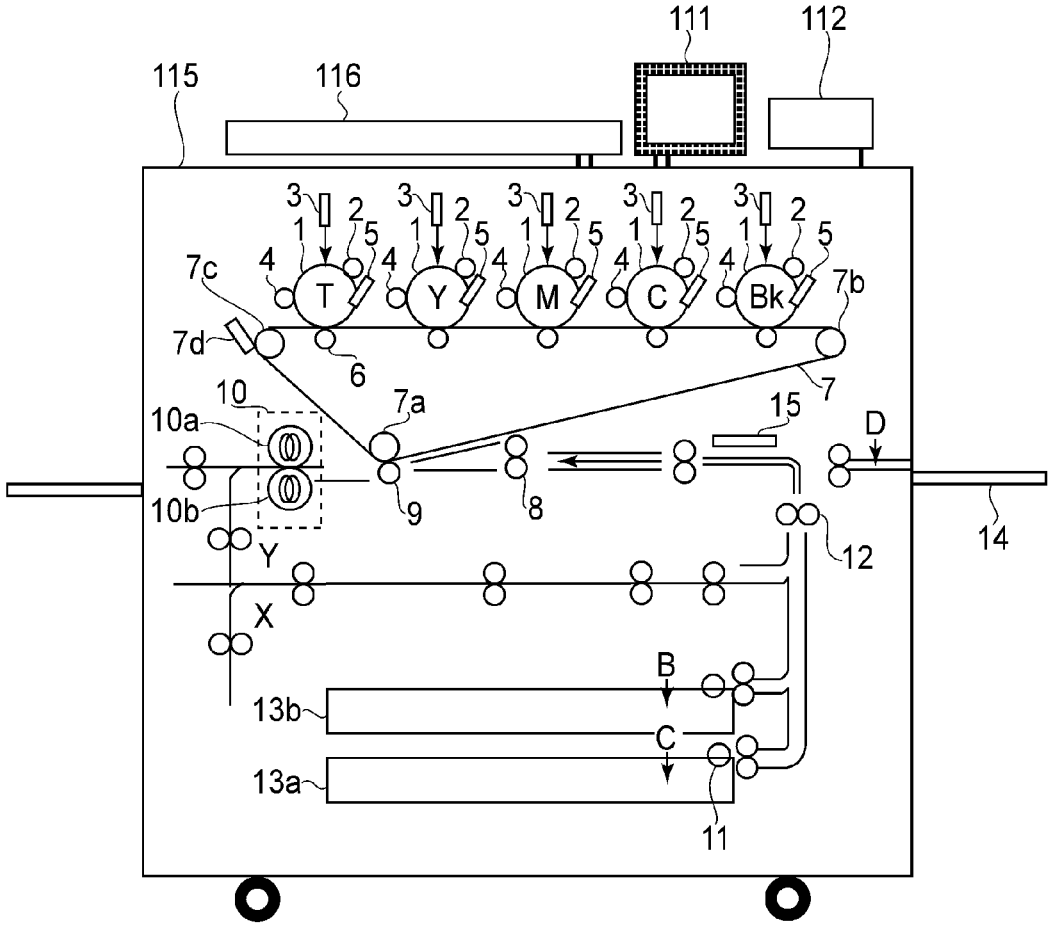
FIG. 2 is a schematic view showing the MFP in the embodiment of the present invention.

FIG. 2 is a schematic view for illustrating a structure of the MFP 100. The scanner portion in this embodiment will be described below. The scanner portion 116 is disposed above the printer portion 115 in FIG. 2. As described above, the scanner portion 116 is constituted by the image sensor as the photoelectric conversion element for reading the original image, the original carriage, and the ADF. The scanner portion 116 obtains the image data of the original set on the original carriage or the ADF. The image data obtained by the scanner portion 116 is sent to the scanner controller 109. The scanner controller 109 can send the image data obtained by the scanner portion 116 to the respective portions connected thereto through the bus 105.

(Printer Portion)

The printer portion 115 in this embodiment will be described. In this embodiment, the printer portion is of an electrophotographic type. For that reason, the printer portion 115 includes a conveyance portion, an image forming portion, and a fixing portion. The conveyance portion, the image forming portion, and the fixing portion will be described below.

(Conveyance Portion)

The conveyance portion is constituted by cassettes 13*a* and 13*b*, a manual feeding tray 14, a pick-up roller 11, a conveyance roller pair 12, and a registration roller pair 8. The sheet as a recording material is set in the cassettes 13*a* and 13*b*. Each of the glossiness, a basis weight, the type, and the like of the sheet set in the cassettes 13*a* and 13*b* can be manually designated by operating the operation panel 102 by the user. A flow of conveyance of the sheet set in the cassette 13*a* will be described.

The sheet set in the cassette 13*a* is fed by the pick-up roller 11 one by one. The sheet fed by the pick-up roller 11 is conveyed by the conveyance roller pair 12. The sheet conveyed by the conveyance roller pair 12 runs into the registration roller pair 8 which is at rest. The sheet which has run into the registration roller pair 8 is conveyed to a secondary transfer portion by the registration roller pair 8 rotated so as to be synchronized with the toner image on the intermediary transfer belt 7.

(Image Forming Portion)

The image forming portion is constituted by image forming stations for respective colors and an intermediary transfer belt unit. An image forming station T for forming the transparent toner image is constituted by a photosensitive drum 1, a charger 2, a laser scanner 3, a developing device 4, a primary transfer roller 6, and a drum cleaner 5. Also with respect to other colors, the image forming stations have the substantially same constitution except for the toner contained in the developing device. The intermediary transfer belt unit is constituted by the intermediary transfer belt 7, a follower roller 7*a*, a secondary transfer opposite roller 7*b*, and a driving roller 7*c*.

The constitution of the image forming portion will be described along a flow of formation of the toner image, for being transferred onto the sheet, on the intermediary transfer belt 7. The transparent toner image is formed by the image forming station T as a transparent image forming means. Similarly, a yellow toner image, a magenta toner image, a cyan toner image, and a black toner image are formed by image forming stations Y, M, C and Bk, respectively, as a color image forming means. The respective image forming stations T, Y, M, C and Bk are substantially horizontally provided. The toner images formed by the respective image forming stations T to Bk are respectively primary-transferred onto the intermediary transfer belt 7. Then, the toner images primary-transferred onto the intermediary transfer belt 7 are secondary-transferred onto the sheet at secondary transfer portion.

The respective image forming stations T to Bk have the substantially same constitution and for this reason, the image forming station T for forming the transparent image will be described representatively. The image forming station T is constituted by the photosensitive drum 1, a charging roller 2, the laser scanner 3, the developing device 4, and the drum cleaner 5. The photosensitive drum 1 having a drum shape as an image bearing member is shaft-supported rotatably by an apparatus main assembly. Around the photosensitive drum 1, the charging roller 2 as a charging means, the laser scanner 3 as an image exposure means, and the developing device as a developing means are disposed.

A surface of the photosensitive drum 1 is electrically charged to a uniform potential by the charging roller 2. Then, an image signal for forming a transparent toner image 23 is inputted from the printer controller 108 into the laser scanner 3. The surface of the photosensitive drum 1 is irradiated with laser light, depending on the inputted image signal, by the laser scanner 3. As a result, electric charges at the surface of the photosensitive drum 1 are neutralized, so that an electrostatic latent image is formed on the surface of the photosensitive drum 1. Then, the electrostatic latent image formed on the surface of the photosensitive drum 1 is developed with transparent toner by the developing device 4. The transparent toner image obtained on the photosensitive drum 1 by the development is primary-transferred onto the intermediary transfer belt 7 as an image conveyance member by a primary transfer roller 6 disposed at a position opposite to the photosensitive drum 1 through the intermediary transfer belt 7. Transfer residual toner, remaining on the photosensitive drum 1, which has not been transferred onto the intermediary transfer belt 7 is collected by the drum cleaner 5. At the image forming station T, the transparent toner image is transferred onto the intermediary transfer belt 7 as described above. Toner images formed by other image forming stations Y, M, C and Bk are also similarly primary-transferred onto the intermediary transfer belt 7. Incidentally, the transparent toner image is first transferred onto the intermediary transfer belt 7 by the image forming station T. Therefore, when the image formation is effected by using the transparent toner, the transparent toner constituted an uppermost layer on the sheet. The transparent image forming station T for forming the transparent image is identical to other image forming stations for forming the color images except for the toner contained in the developing device 4. For that reason, depending on the image signal inputted into the laser scanner, the transparent image forming station T is capable of forming the transparent toner image on an entire sheet surface or on a part of the sheet surface.

The intermediary transfer belt 7 is stretched by the follower roller 7*a*, the secondary transfer opposite roller 7*b*, and the driving roller 7*c*. The follower roller 7*a* also functions as a tension roller, thus being rotated by the movement of the intermediary transfer belt 7 while imparting tension to the intermediary transfer belt 7. The secondary transfer opposite roller 7*b* is disposed opposite to a secondary transfer roller 9 through the intermediary transfer belt 7. Further, to the secondary transfer opposite roller 7*b*, a secondary transfer bias voltage is applied from a high-voltage power source (not shown) during the secondary transfer. The driving roller 7*c* is rotated by receiving a driving force from a driving motor (not shown). The intermediary transfer belt 7 stretched by the driving roller 7*c* is moved by the rotation of the driving roller 7*c* by receiving the driving force from the driving roller 7*c*.

In this manner, the toner images formed on the intermediary transfer belt 7 by the respective image forming stations T to Bk are conveyed to the secondary transfer portion. The toner images conveyed by the intermediary transfer belt 7 are transferred onto the sheet, conveyed to the secondary transfer portion, by applying a transfer bias to the secondary transfer roller 9 and the secondary transfer opposite roller 7*c*. Transfer residual toner, remaining on the intermediary transfer belt 7, which has not been transferred onto the sheet is collected by a belt cleaner 7*d* provided downstream of the secondary transfer portion.

In this manner, the toner images are transferred onto the sheet. The sheet onto which the toner images are transferred is conveyed to a fixing portion.

(Toner)

The toner accommodated in the developing device of the image form station will be described. In this embodiment, with respect to the transparent toner and the color toners, a polyester-based resin material is used. As a method of manufacturing the toner, a pulverization method and a method (polymerization method) for directly manufacturing the toner in a medium, such as a suspension polymerization method, an interfacial polymerization method, or a dispersion polymerization method can be used. In this embodiment, the toner manufactured by using the suspension polymerization method was used. The component and manufacturing method for the toner are not limited to those described above. Herein, the color toner is a generic name for yellow toner, cyan toner, magenta toner, and black toner, excluding the transparent toner.

The color toner is principally constituted by a polyester resin material and a pigment. Further, the transparent toner is principally constituted by the polyester resin material. The transparent toner and the color toners, used in this embodiment, have a glass transition point (Tg) of about 55° C. In this embodiment, the transparent toner was manufactured so as to have the glass transition point (Tg) substantially identical to that of the color toners. For that reason, in the case where the same fixing condition and the substantially same toner amount per unit area are employed for the transparent toner and the color toners, the color toners fixed on the sheet and the transparent toner fixed on the sheet have the substantially same glossiness.

The glass transition point (Tg) is not limited to that described above. When the type and a molecular weight of the resin material used for the transparent toner is changed, a melting proper is also changed. For that reason, the toner image fixed on the sheet under the same fixing condition provides a different glossiness depending on a toner property. Therefore, by manufacturing the transparent toner with the use of a resin material which has the glass transition point (Tg) lower than that of the color toners and is therefore liable to melt, compared with the case of the color toners, it is possible to obtain the transparent toner having high glossiness after the fixation. Further, by manufacturing the transparent toner with the use of a resin material which has the glass transition point (Tg) higher than that of the color toners and is therefore less liable to melt, compared with the case of the color toners, it is possible to obtain the transparent toner having low glossiness after the fixation. In this way, it is also possible to use the transparent toner having the glass transition point (Tg) different from that of the color toners.

(Fixing Portion)

The fixing portion is constituted by the fixing device 10. The constitution of the fixing portion will be described along a flow of fixation of the transparent images transferred onto the sheet. The fixing device 10 is constituted by a fixing roller 10*a* and a pressing roller 10*b*. The fixing roller 10*a* and the pressing roller 10*b* press-contact each other and a fixing nip is formed therebetween. In this embodiment, outer diameters of the fixing roller 10*a* and the pressing roller 10*b* are both 80 mm. Further, lengths of the fixing roller 10*a* and the pressing roller 10*b* with respect to their rotational axis directions are both 350 mm. The fixing roller 10*a* is shaft-supported rotatably by another wall of the fixing device, and the pressing roller 10*b* is pressed against the fixing roller 10*a* with a pressure of 500 N by a spring (not shown). The fixing roller 10*a* is a laminated member including, on an aluminum-made hollow core metal, a rubber layer as an elastic layer and a fluorine-containing resin material layer as a toner parting layer which are laminated. Further, inside the hollow core metal, a halogen heater as a heating source is provided. The hollow core metal may also be formed of other materials such as iron. Further, the heating source may also be replaced with that of an IH (induction heating) type using, e.g., electromagnetic induction heating. The fixing roller 10*a* is connected to a driving motor through a driving gear train and is rotated by a rotational driving force transmitted from the driving motor. The pressing roller 10*b* is, similarly as the fixing roller 10*a*, a lamination member in which the rubber layer and the fluorine-containing resin material layer are laminated, and the halogen heater is provided inside the hollow core metal. Further, the pressing roller 10*b* is rotated by the rotation of the fixing roller 10*a*.

In the neighborhood of each of the surfaces of the fixing roller 10*a* and the pressing roller 10*b*, a thermistor as a detecting means for detecting a temperature of an associated surface is mounted. The respective thermistors can detect the temperatures of the fixing roller 10*a* and the pressing roller 10*b*. A temperature detection signal output from each of the thermistor is sent to the printer controller 108. As a result, the printer controller can control the temperatures of the fixing roller 10*a* and the pressing roller 10*b*.

In this embodiment, the printer controller 108 controls a halogen heater for each of the rollers 10*a* and 10*b* so that the temperature in the neighborhood of the surface of the fixing roller 10*a* is 155° C. and so that the temperature in the neighborhood of the surface of the pressing roller 10*b* is 100° C.

Under such a fixing condition, the sheet on which the toner images are transferred at the secondary transfer portion passes through the fixing nip. As a result, the toner images transferred on the sheet are fixed on the sheet. The sheet on which the toner images are fixed passed through a conveyance path and is discharged outside the image forming apparatus.

In this embodiment, the sheet is separated from the fixing device 10, in a state in which a high temperature of about 90° C. to about 110° C. is kept, immediately after the sheet has passed through the fixing nip of the fixing device 10. The temperature at which the sheet is separated is affected by the fixing condition, the basis weight of the sheet, and the like. In this embodiment, the fixing device 10 constituted by a roller pair consisting of the fixing roller 10*a* and the pressing roller 10*b* is described above but may also be constituted by an endless belt for either one or both of a fixing side and a pressing side. The fixing method may also be those other than the above-described fixing method.

The constitution of the printer portion along the flow of the toner image formation on the sheet is described above.

(Relationship Between Toner Amount Per Unit Area and Glossiness)

Figure 3:
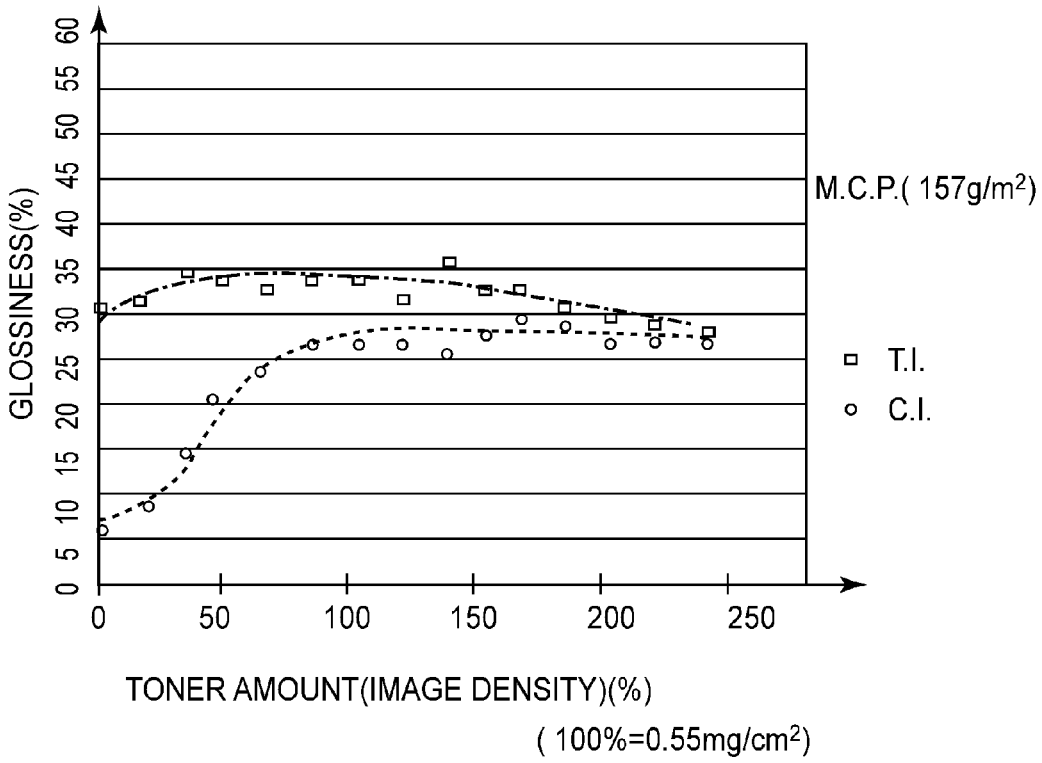
FIG. 3 is a graph showing a relationship between a change in toner amount and a change in glossiness with respect to low glossy paper.

FIG. 3 is a graph showing a relationship between the amount per unit area of the toner fixed on the sheet surface and the glossiness of the sheet surface on which the transparent image is fixed. An ordinate represents the glossiness. An abscissa represents the amount of the color toner fixed on the sheet. Here, a curve indicated by a broken line represents the glossiness when the color image is fixed on the sheet. Further, a curve indicated by a chain line represents the glossiness when the color image and 70%-density transparent image are simultaneously transferred and fixed on the sheet.

Various conditions which are considered to affect the glossiness of the sheet surface after the fixation will be enumerated below. As the sheet, matt coated paper ("U-light" (trade name), mfd. by Nippon Paper Industries Co., Ltd.; basis weight=157 g/m$^2$) was used. Further, the printer controller 108 controls the printer portion 115 so that the amount of the toner to be formed on the sheet is about 0.55 mg/cm$^2$ when a signal for the image density of 100% is input.

Further, the printer controller 108 controls the printer portion 115 so that the surface temperature of the fixing roller 10*a* is about 155° C. and a process speed at which the sheet passes through the fixing device is 285 mm/s.

Further, the toner used is, as described above, the toner which employs the polyester resin and has the glass transition point (Tg) of about 55° C.

The relationship between the toner amount and the glossiness as shown in FIG. 3 varies depending on the sheet on which the image is to be formed, an environmental condition, the type of the toner used for image formation, the process speed, and the like. For that reason, the relationship between, the toner amount and the glossiness, used for the control is stored in the ROM, and HDD, or the like in the form of an LUT (look-up table).

(Operation Explanation of MFP Along Flow Chart)

Hereinbelow, a designated screen for a file indicating an area, in which the glossiness is intended to be operated, used in the processing along the flow chart described later and a screen for obtaining information as to whether the glossiness in the designated area is intended to be increased or decreased will be described. Then, the operation of the MFP depending on the information input by the user will be described by using the flow chart.

Hereinafter, the area in which the glossiness is intended to be operated and the information designating whether the glossiness in the area in which the glossiness is intended to be operated is intended to be increased or decreased are referred to as transparent print setting information.

Figure 4:
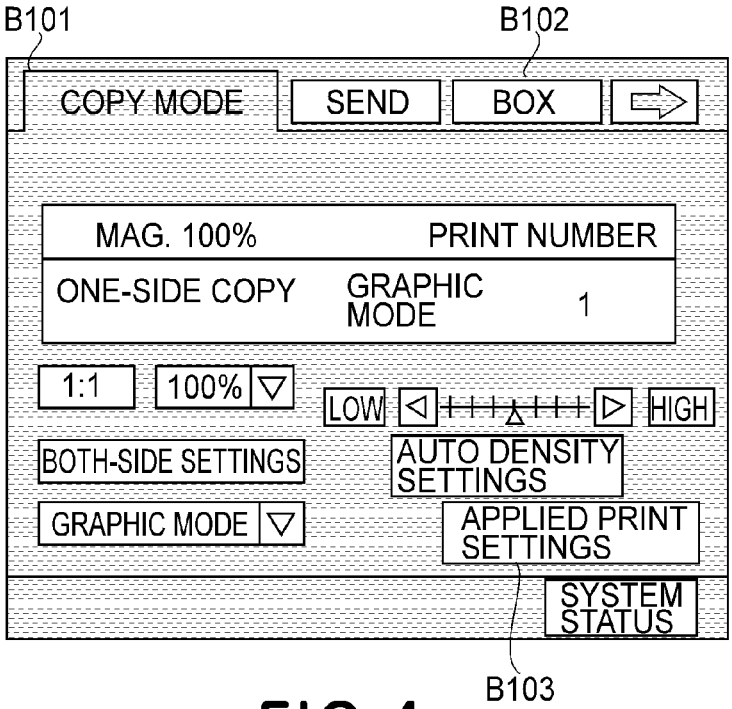
FIGS. 4 and 5 are schematic views each showing an example of a screen displayed on a display of the MFP in the embodiment of the present invention.

(Explanation for Screen Shown in FIG. 4)

FIG. 4 is a schematic view showing an example of the screen to be displayed at the display 111. In a state in which the screen shown in FIG. 4 is displayed at the display 111 (in the copy mode), when a start button (not shown) is pressed by the user, the MFP 100 makes a copy of the original set on the original carriage. The mode of the MFP 100 is changed to a box mode by selection of B102 by the user. In the box mode, the user can output data stored in the HDD provided inside the MFP 100 at the printer portion. By selection of B101 by the user, the box mode of the MFP 100 changed to the copy mode.

In FIG. 4, the user can select B104 for "APPLIED PRINT SETTINGS". When the user selects "TRANSPARENT PRINT SETTINGS" (not shown) in the "APPLIED PRINT SETTINGS", the MFP 100 displays the screen shown in FIG. 5 at the display 111.

Figure 5:
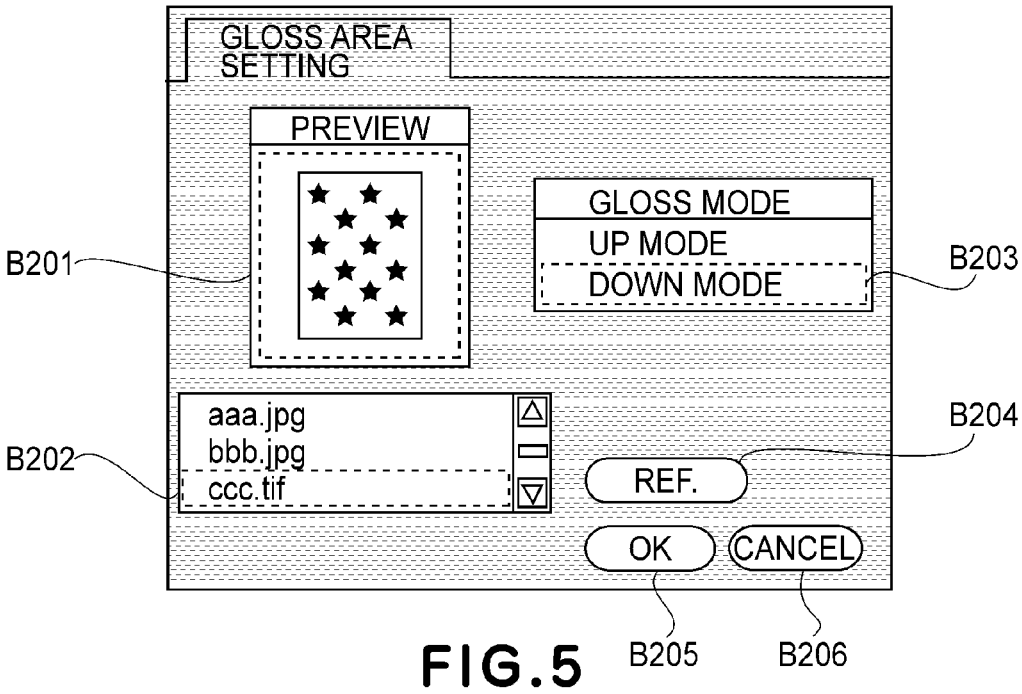

(Explanation for Screen Shown in FIG. 5)

FIG. 5 is a schematic view showing a screen for urging the user to input the transparent print setting information. The MFP 100 displays the screen as shown in FIG. 5 at the display 111. As a result, the MFP 100 can obtain the transparent print setting information set by the user. Here, the transparent print setting information refers to information indicating the area in which the glossiness is intended to be operated and mode information designating how to adjust the glossiness in the area in which the glossiness is intended to be operated with respect to the glossiness in an adjacent area.

A preview area B201 shows the area, in which the glossiness is intended to be operated, selected by the user. Here, the area in which the glossiness is intended to be operated is represented by "★". Hereinafter, the area, in which the glossiness is intended to be operated, designated by the user ("★" portion in FIG. 5) is referred to as a marked portion. Further, the area except for the area in which the glossiness is intended to be operated is referred to as a background portion. An image file B202 is stored in the HDD of the MFP 100. The user designates the area, in which the glossiness is intended to be operated, by using image files displayed in list form. In FIG. 5, "ccc.tif" is selected. B204 is a button for designating a file, through network, for designating the area in which the glossiness is intended to be operated. As a result, the area in which the glossiness is intended to be operated can be designated by using the file other than the files stored inside the MFP 100.

B203 represents a button for designating a mode in which the glossiness in the area in which the glossiness is intended to be operated is intended to be made relatively high or relatively low. In the case where the user wishes to make the glossiness in the designated area relatively high, the user can select a "GLOSS UP MODE". Further, in the case where the user wishes to make the glossiness in the designated area relatively low, the user can select a "GLOSS DOWN MODE". As a result, the CPU 101 as a mode obtaining means obtains information indicating the mode designated by the user (hereinafter referred to as mode information).

In a state in which the transparent print setting information is set, the user can reflect the transparent print setting information by selecting a button B205 (OK button). In the case where the user selects the button B205 (OK button), the MFP 100 displays the screen shown in FIG. 4 at the display 111. The user can effect image formation on the basis of the transparent print setting information by pushing down the start button in the state in which the transparent print setting information is reflected.

Further, the user can destruct the transparent print setting information by selecting a button B206 (cancel button).

Next, the operation of the MFP using the transparent print setting information will be described along the flow chart.

(Operation Explanation of MFP Along Flow Chart)

Figure 6:
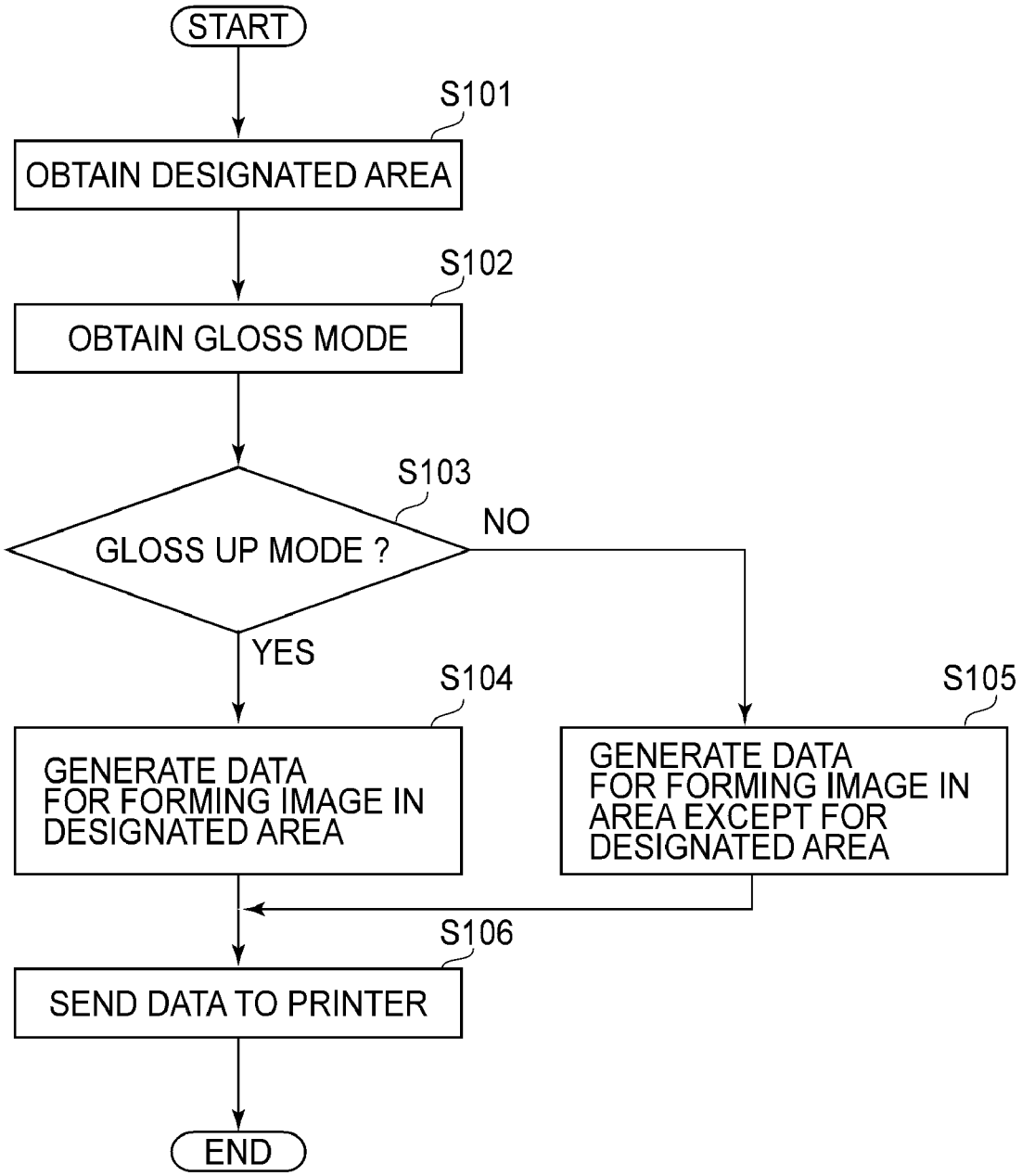
FIG. 6 is a flow chart showing an execution procedure of image processing in the embodiment of the present invention.

FIG. 6 is a flow chart for illustrating the operation of the MFP 100. The CPU 101 controls the MFP 100 in accordance with a program stored in the ROM 103. The respective steps will be specifically described.

S101 represents a step for obtaining the area, in which the glossiness is intended to be operated, designated by the user. The CPU 101 as an area obtaining means obtains information designating the area in which the glossiness is to be operated.

S102 represents a step for obtaining an glossiness operating mode. The CPU 101 as a mode obtaining means obtains mode information designated by the user. The CPU 101 obtains information on "GLOSS UP MODE" (first mode) in which the glossiness in the area obtained in the step S101 is relatively increased or "GLOSS DOWN MODE" (second mode) in which the glossiness is relatively decreased.

S103 represents a step for determining image data, for forming an image with the transparent toner, generated on the basis of the mode information obtained in the step S102 (hereinafter referred to as transparent image data). The CPU 101 executes processing in a step S104 when the mode information obtained in the step S102 is the "GLOSS UP MODE". Further, the CPU 101 executes processing in a step S105 when the mode information obtained in the step S102 is the "GLOSS DOWN MODE".

S104 represents a step performed in the case where the glossiness in the area obtained in the step S101 is intended to be relatively increased. The CPU 101 as a transparent image data generating means generates the transparent image data for forming the transparent toner image in the area obtained in the step S101.

S105 represents a step performed in the case where the glossiness in the area obtained in the step S101 is intended to be relatively decreased. The CPU 101 as a transparent image data generating means generates the transparent image data for forming the transparent toner image in an image formable area except for the area obtained in the step S101.

S106 represents a step for sending the transparent image data to the printer portion. The CPU 101 sends the transparent image data, generated in the step S104 or in the step S105, to the printer portion. The transparent image station T having received the transparent image data forms the transparent toner image on the sheet on the basis of the transparent image data. The transparent toner image formed on the sheet is fixed on the sheet by the fixing device 10.

As a result, when the "GLOSS UP MODE" is selected by the user, it is possible to relatively increase the glossiness in the area, in which the glossiness is intended to be operated, designated by the user. Further, when the "GLOSS DOWN MODE" is selected by the user, it is possible to relatively decrease the glossiness in the area, in which the glossiness is intended to be operated, designated by the user.

(Operation for Forming Transparent Image Data on Sheet)

Figure 7:
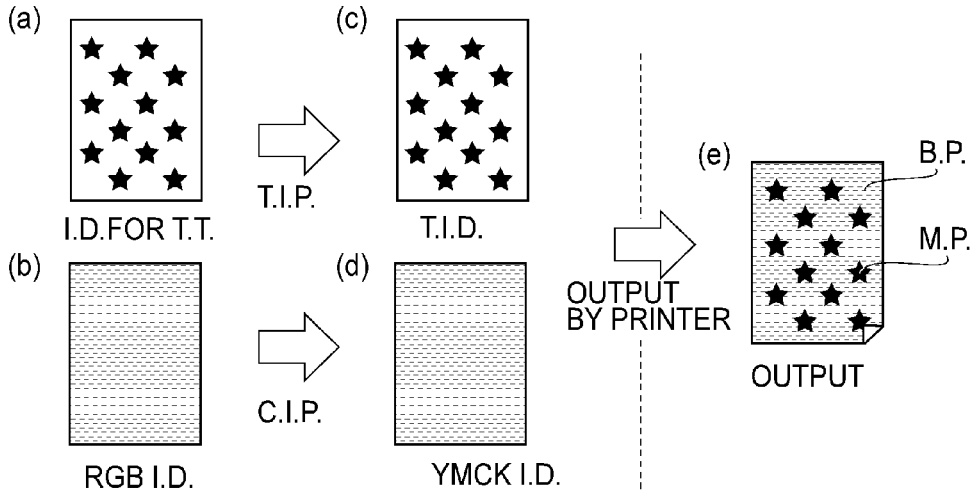
FIGS. 7(*a*) to 7(*e*) and FIGS. 8(*a*) to 8(*e*) are schematic views for illustrating an image to be processed by and a print to be output by an image processing apparatus in the embodiment of the present invention.
Figure 8:
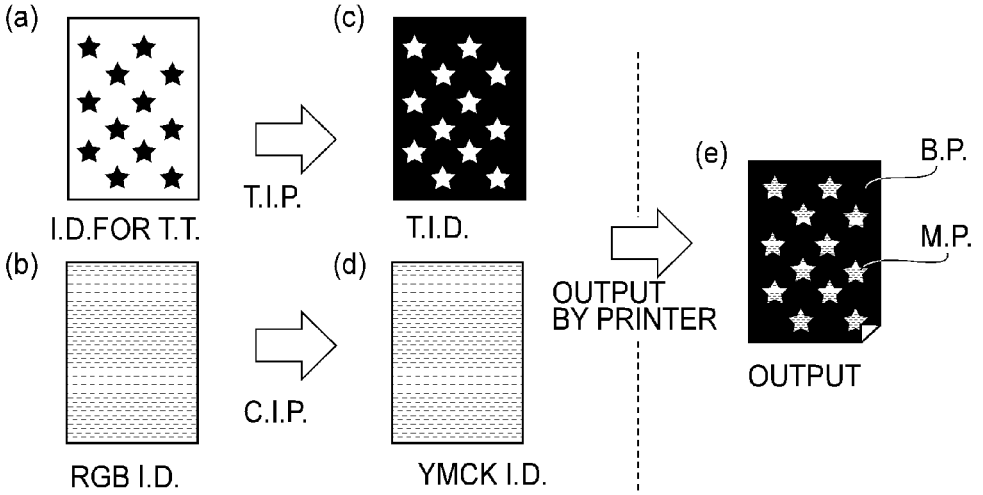

FIGS. 7(*a*) to 7(*e*) and FIGS. 8(*a*) to 8(*e*) are schematic views for illustrating flow of formation of the transparent image data on the sheet. The area in which the glossiness is intended to be operated and a relationship between the transparent image and the transparent image data generated depending on the selected mode will be described below.

FIGS. 7(*a*) to 7(*e*) are schematic views for illustrating a manner of converting the image data into the transparent image data for forming the transparent toner image in the area in which the glossiness is intended to be operated. In the case where the sheet on which the image is to be formed is the matt coated paper and the mode information is the "GLOSS UP MODE", the transparent toner image is formed in the area in which the glossiness is intended to be operated. The CPU 101 generates transparent image data (FIG. 7(*c*)), to be sent to the printer portion, from input image data (FIG. 7(*a*)) designating the area in which the glossiness is intended to be operated. Further, the CPU 101 generates YMCK image data (FIG. 7(*d*)) represented by YMCK values, to be used at the printer portion, from, e.g., RGB image data (FIG. 7(*b*)) represented by RGB values. The printer portion forms the transparent image on the sheet, on the basis of the received transparent image data and the YMCK data, so as to cover the color image (FIG. 7(*e*)).

Similarly, FIGS. 8(*a*) to 8(*e*) are schematic views for illustrating a manner of converting the image data into the transparent image data for forming the transparent toner image in the area except for the area in which the glossiness is intended to be operated. In the case where the sheet on which the image is to be formed is the matt coated paper and the mode information is the "GLOSS DOWN MODE", the transparent toner image is formed in the area except for the area in which the glossiness is intended to be operated. The CPU 101 generates transparent image data (FIG. 8(*c*)), to be sent to the printer portion, from input image data (FIG. 8(*a*)) designating the area in which the glossiness is intended to be operated. Further, the CPU 101 generates YMCK image data (FIG. 8(*d*)) represented by YMCK values, to be used at the printer portion, from, e.g., RGB image data (FIG. 8(*b*)) represented by RGB values. The printer portion forms the transparent image on the sheet, on the basis of the received transparent image data and the YMCK data, so as to cover the color image (FIG. 8(*e*)).

The glossiness at the marked portion (M.P.) and the glossiness at the background portion (B.P.) with respect to each of respective output products (FIG. 7(*e*) and FIG. 8(*e*)) will be described with the use of Tables 1 and 2.

TABLE 1

| | | M.P. | B.P. |
|---|---|---|---|
| Image density signal (%) | Color | 20 | 20 |
| | Transparent | 70 | 0 |
| Toner amount ($mg/cm^2$) | | 0.50 | 0.11 |
| 60°-glossiness (%) | | 36 | 8 |

Table 1 shows the glossiness at the marked portion and the glossiness at the background portion with respect to the output product shown in FIG. 7(*e*)). Incidentally, as the sheet for printing, the matt coated paper ("U-light" (trade name), mfd. by Nippon Paper Industries Co., Ltd.; basis weight=157 $g/m^2$) was used. For designating the area in which the glossiness was intended to be operated, a file "aaa.tif" was used. Further, the selected mode was the "GLOSS UP MODE". Here, as respective image data, data for providing the color toner with uniform 20%-density and data for providing the transparent toner with 70%-density were used.

The glossiness at the marked portion where the toner image was formed on the matt coated paper with 90%-density is 36% and the glossiness at the background portion where the toner image was formed on the matt coated paper with 20%-density is 8% (on the basis of the relationship shown in FIG. 3).

For that reason, the glossiness of 36% at the marked portion is higher than the glossiness of 8% at the background portion. As a result, with respect to the matt coated paper, the marked portion glossiness can be made relatively higher than the background portion glossiness.

TABLE 2

| | | M.P. | B.P. |
|---|---|---|---|
| Image density signal (%) | Color | 20 | 20 |
| | Transparent | 0 | 70 |
| Toner amount ($mg/cm^2$) | | 0.11 | 0.50 |
| 60°-glossiness (%) | | 8 | 36 |

Table 2 shows the glossiness at the marked portion and the glossiness at the background portion with respect to the output product shown in FIG. 8(*e*)). Incidentally, as the sheet for printing, the matt coated paper ("U-light" (trade name), mfd. by Nippon Paper Industries Co., Ltd.; basis weight=157 $g/m^2$) was used. For designating the area in which the glossiness was intended to be operated, a file "aaa.tif" was used. Further, the selected mode was the "GLOSS DOWN MODE". Here, as respective image data, data for providing the color toner with uniform 20%-density and data for providing the transparent toner with 70%-density were used.

The glossiness at the marked portion where the toner image was formed on the matt coated paper with 20%-density is 8% and the glossiness at the background portion where the toner image was formed on the matt coated paper with 90%-density is 36% (on the basis of the relationship shown in FIG. 3).

For that reason, the glossiness of 8% at the marked portion is lower than the glossiness of 36% at the background portion. As a result, with respect to the matt coated paper, the marked portion glossiness can be made relatively lower than the background portion glossiness.

That is, it is possible to obtain the output products depending on the mode selected by the user ("GLOSS UP MODE" or "GLOSS DOWN MODE").

(Case where Color Image Forming Sheet is Highly Glossy Paper)

In recent years, the sheet on which the image is to be formed is diversified. Particularly, in the field of commercial printing, many types of the sheets are used. In some cases, the user uses a highly glossy sheet which has not been used.

As an example, a relationship between the toner amount and the glossiness in the case of using the gloss coated paper is described below. Subsequently, on the basis of the relationship, a flow chart showing a transparent image forming procedure depending on the mode designated by the user will be described.

(Relationship Between Toner Amount and Glossiness with Respect to Highly Glossy Paper)

The relationship between the toner amount and the glossiness in the case where the gloss coated paper is used as the image forming sheet will be described. Here, as the gloss coated paper, "Golden Cask Super Art" (trade name) (mfd. by Oji Paper Co., Ltd.) having a basis weight of 157 $g/m^2$ was used. The various conditions (process speed, nip pressure, and the like) which are considered to affect the glossiness of the sheet surface after the fixation are identical to those in the case of the low glossy paper. The "Golden Cask Super Art" (basis weight=157 $g/m^2$) is classified into the highly glossy paper since the glossiness at a portion where the transparent image is fixed is lowered. Hereinafter, the sheet on which the glossiness is lowered after the transparent image fixation compared with the glossiness before the transparent image fixation is referred to as the highly glossy paper. The degree of the glossiness lowering varies depending on the fixing condition and the type of the toner.

Figure 9:
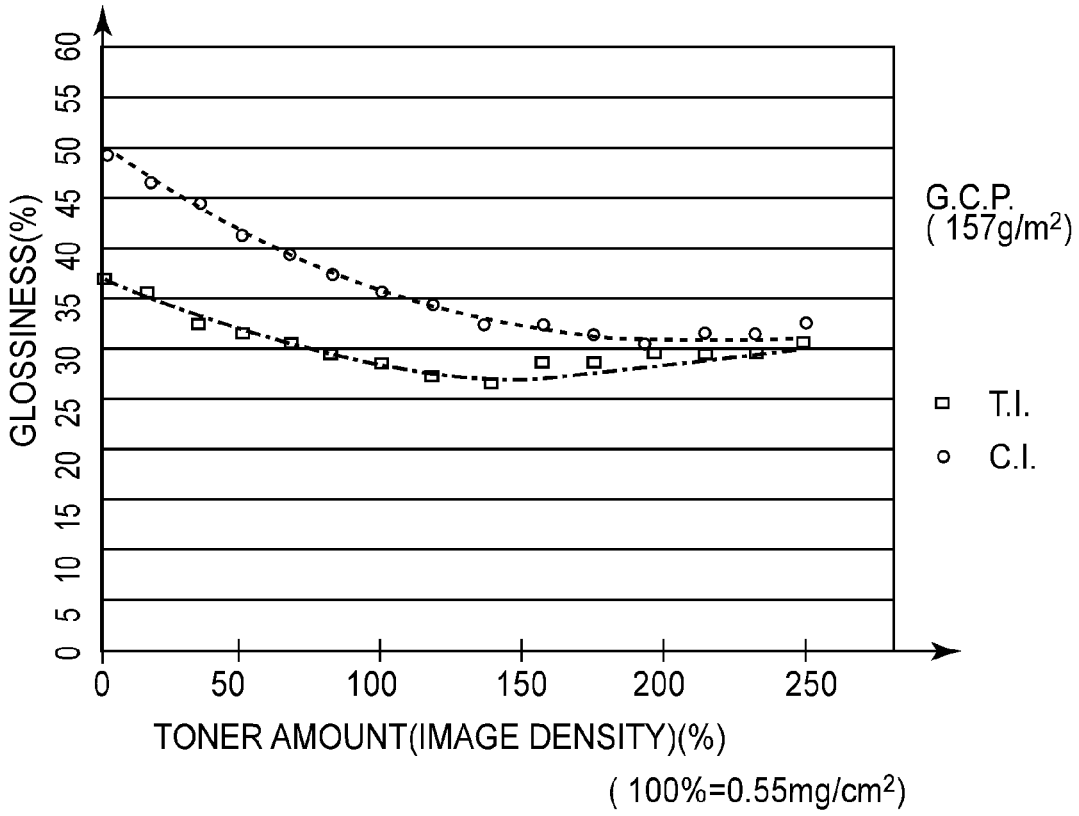
FIG. 9 is a graph showing a relationship between a change in toner amount and a change in glossiness with respect to highly glossy paper.

FIG. 9 is a graph showing a relationship between the glossiness and the toner amount when the transparent image is fixed on the highly glossy paper. An abscissa represents the toner amount per unit area (image density). An ordinate represents the glossiness. Here, a curve indicated by a broken line represents the glossiness when the color image is fixed on the sheet. Further, a curve indicated by a chain line represents the glossiness when the color image and 70%-density transparent image are simultaneously transferred and fixed on the sheet. The glossiness was measured by using the above-described gloss meter.

Hereinafter, the sheet which is increased in glossiness compared with that before the fixation by fixing the toner is referred to as the low glossy paper. A degree of the glossiness increase varies depending on the fixing condition and the type of the toner.

As shown in FIG. 3, the matt coated paper "U-light" (basis weight=157 $g/m^2$) is classified into the low glossy paper since the glossiness at the portion where the toner is fixed is increased. With respect to the toner and under the fixing condition in this embodiment, the glossiness of the sheet as a threshold for classifying the sheet into the highly glossy paper and the low glossy paper is 20%. Incidentally, under the above condition, the glossiness of 20% corresponds to predetermined glossiness (threshold) used in the flow chart described later.

(Operation Explanation of MFP Along Flow Chart)

Figure 10:
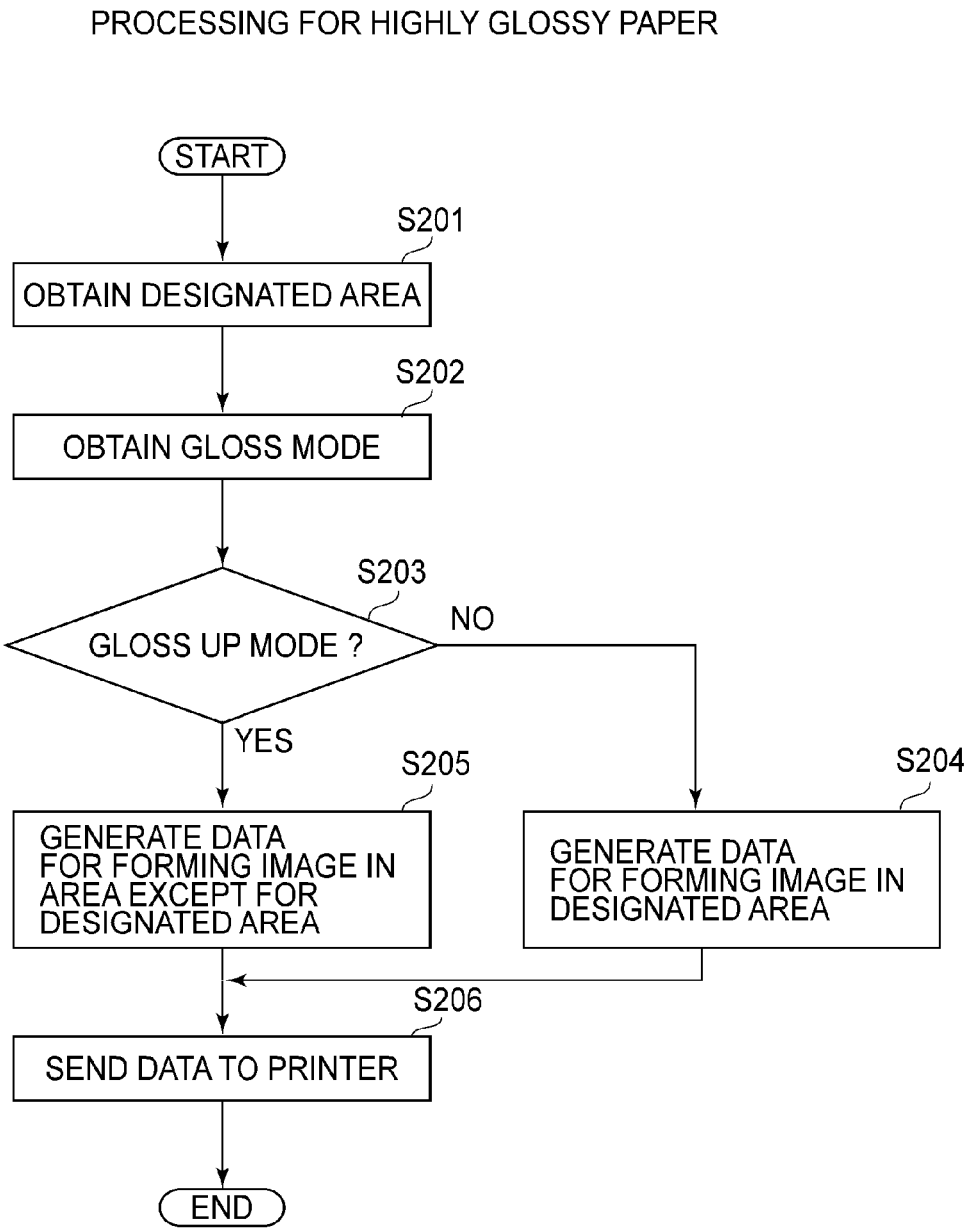
FIG. 10 is a flow chart showing another execution procedure of image processing in the embodiment of the present invention.

FIG. 10 is a flow chart for illustrating the operation of the MFP 100 when the sheet on which the image is to be formed is the highly glossy paper. The CPU 101 controls the MFP 100 in accordance with a program stored in the ROM 103. The respective steps will be specifically described.

S201 represents a step for obtaining the area, in which the glossiness is intended to be operated, designated by the user. The CPU 101 as an area obtaining means obtains information designating the area in which the glossiness is to be operated.

S202 represents a step for obtaining an glossiness operating mode. The CPU 101 as a mode obtaining means obtains mode information designated by the user. The CPU 101 obtains information on "GLOSS UP MODE" (first mode) in which the glossiness in the area obtained in the step S201 is relatively increased or "GLOSS DOWN MODE" (second mode) in which the glossiness is relatively decreased.

S203 represents a step for determining transparent image data, for forming an image with the transparent toner, generated on the basis of the mode information obtained in the step S202. The CPU 101 executes processing in a step S204 when the mode information obtained in the step S202 is the "GLOSS UP MODE". Further, the CPU 101 executes processing in a step S205 when the mode information obtained in the step S202 is the "GLOSS DOWN MODE".

S204 represents a step performed in the case where the glossiness in the area obtained in the step S201 is intended to be relatively increased. The CPU 101 as a transparent image data generating means generates the transparent image data for forming the transparent toner image in an image formable area except for the area obtained in the step S201.

S205 represents a step performed in the case where the glossiness in the area obtained in the step S101 is intended to be relatively decreased. The CPU 201 as a transparent image data generating means generates the transparent image data for forming the transparent toner image in the area obtained in the step S201.

S206 represents a step for sending the transparent image data to the printer portion. The CPU 101 sends the transparent image data, generated in the step S204 or in the step S205, to the printer portion. The transparent image station T having received the transparent image data forms the transparent toner image on the sheet on the basis of the transparent image data. The transparent toner image formed on the sheet is fixed on the sheet by the fixing device 10.

As a result, even in the case where the image forming sheet is the highly glossy paper such as the gloss coated paper, the glossiness in the area designated by the user can be relatively increased or decreased as the user wishes.

(Glossiness of Output Product)

In order to increase the glossiness at the designated portion with respect to the gloss coated paper as the highly gloss paper, the transparent toner image is formed in the area except for the designated portion. That is, when the user selects the "GLOSS UP MODE", the output product as shown in FIG. 8(*e*) as an example is obtained.

Further, in order to decrease the glossiness at the designated portion, the transparent toner image is formed at the designated portion. That is, when the user selects the "GLOSS DOWN MODE", the output product as shown in FIG. 7(*e*) as an example is obtained.

The glossiness at the marked portion (M.P.) and the glossiness at the background portion (B.P.) with respect to of the output product when the "GLOSS UP MODE" is selected will be described below with the use of Table 3.

TABLE 3

| | | M.P. | B.P. |
|---|---|---|---|
| Image | Color | 20 | 20 |
| Density signal (%) | Transparent | 0 | 70 |
| Toner amount ($mg/cm^2$) | | 0.11 | 0.50 |
| 60°-glossiness (%) | | 47 | 36 |

Table 3 shows the glossiness at the marked portion and the glossiness at the background portion of the print output when the gloss coated paper ("Golden Cask Super Art" (trade name), mfd. by Oji Paper Co., Ltd.; basis weight=157 $g/m^2$) is used and the "GLOSS UP MODE" is selected. Incidentally, for designating the area in which the glossiness was intended to be operated, a file "aaa.tif" was used. Here, as respective image data, data for providing the color toner with uniform 20%-density and data for providing the transparent toner with 70%-density were used.

The glossiness at the marked portion where the toner image was formed on the gloss coated paper with 20%-density is 47% and the glossiness at the background portion where the toner image was formed on the gloss coated paper with 90%-density is 36% (on the basis of the relationship shown in FIG. 9).

For that reason, the glossiness of 47% at the marked portion is higher than the glossiness of 36% at the background portion. As a result, also with respect to the gloss coated paper, the marked portion glossiness can be made relatively higher than the background portion glossiness.

Next, the glossiness at the marked portion (M.P.) and the glossiness at the background portion (B.P.) with respect to of the output product when the "GLOSS DOWN MODE" is selected will be described with the use of Table 3.

TABLE 4

| | | M.P. | B.P. |
|---|---|---|---|
| Image density signal (%) | Color | 20 | 20 |
| | Transparent | 70 | 0 |
| Toner amount ($mg/cm^2$) | | 0.50 | 0.11 |
| 60°-glossiness (%) | | 36 | 47 |

Table 4 shows the glossiness at the marked portion and the glossiness at the background portion of the print output when the gloss coated paper ("Golden Cask Super Art" (trade name), mfd. by Oji Paper Co., Ltd.; basis weight=157 $g/m^2$) is used and the "GLOSS DOWN MODE" is selected. Incidentally, for designating the area in which the glossiness was intended to be operated, a file "aaa.tif" was used. Here, as respective image data, data for providing the color toner with uniform 20%-density and data for providing the transparent toner with 70%-density were used.

The glossiness at the marked portion where the toner image was formed on the gloss coated paper with 90%-density is 36% and the glossiness at the background portion where the toner image was formed on the gloss coated paper with 20%-density is 47% (on the basis of the relationship shown in FIG. 9).

For that reason, the glossiness of 36% at the marked portion is lower than the glossiness of 47% at the background portion. As a result, also with respect to the gloss coated paper, the marked portion glossiness can be made relatively higher than the background portion glossiness.

As described above, the behavior varies depending on the sheet used and therefore there is the need to consider the type of the sheet on which the image is to be formed. An example for obtaining information on the type of the sheet is shown below and an operation of the MFP on the basis of its information will be described along a flow chart.

In this embodiment, the information on the type of the sheet is to be input by the user. An example of a screen for urging the user to input the type of the sheet is shown below. Incidentally, a method of obtain the information on the type of the sheet is not limited to direct input by the user but may also be, e.g., the use of the gloss sensor.

Figure 11:
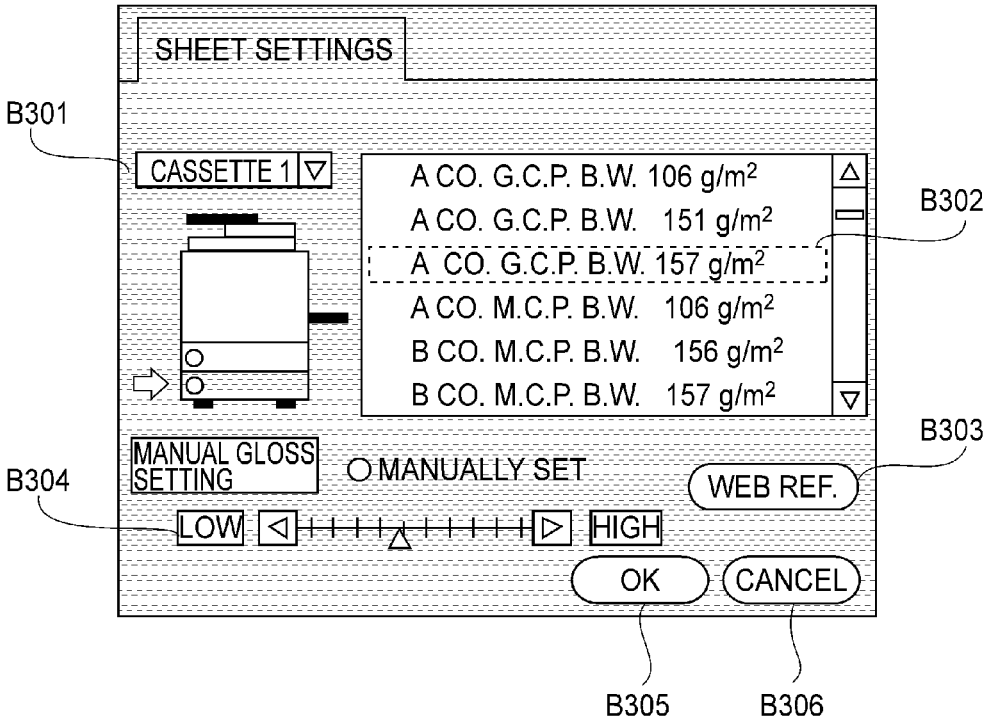
FIG. 11 is a schematic view showing another example of the screen displayed on the display of the MFP in the embodiment of the present invention.

(Explanation for Screen Shown in FIG. 11)

FIG. 11 is a schematic view showing the example of the screen for urging the user to input "information on sheet glossiness". The user can select the cassette 13*a*, the cassette 13*b*, and the manual feeding tray 14, each in which the sheets used for printing are set, as shown in FIG. 2. When the user selects B301, "CASSETTE 1", "CASSETTE 2", and "MANUAL FEEDING TRAY" are selectably presented on the display 111 in the form of a pull-down menu. It is also possible to employ other option presentation methods such as a pop-up menu and the like menu. The user selects the item, in which (on which) the sheets used for printing are set, from the presented items. As shown in FIG. 11, when the user selects the "CASSETTE 1", on the display 111, the type of sheets selectable by the user is presented in list form. The paper ("Golden Cask Super Art"; basis weight=157 g/m$^2$ has been set in the "CASSETTE 1" and the paper ("U-light"; basis weight=157 g/m$^2$) has been set in the "CASSETTE 2". For that reason, when the user select the "CASSETTE 1" from the pull-down menu, the CPU 101 controls a cursor B302 so as to be positioned at "A CO. G. C. P. B. W. (A Company; gloss coated paper; basis weight) 157 g/m$^2$" corresponding to the paper ("Golden Cask Super Art"; basis weight=157 g/m$^2$). Further, in the case where the "CASSETTE 2" is selected from the selectably presented pull-down menu, the CPU 101 controls the cursor B302 so as to be positioned at "B CO. M. C. P. B. W. (B company; matt coated paper; basis weight) 157 g/m$^2$" corresponding to the paper ("U-light"; basis weight=157 g/m$^2$). For example, in the case where the user sets the "A CO. G. C. P. B. W. 157 g/m$^2$" in the "CASSETTE 1", the user performs the following operation. First, the user selects the "CASSETTE 1". Then, the user operates the cursor (B302) so as to be positioned at "A CO. G. C. P. B. W. 157 g/m$^2$". By performing such an operation, the user can designate the type of the sheet used for printing with respect to the MFP 100. The MFP 100 holds data shown in Table 5 below indicating the types of sheets presented in FIG. 11. For that reason, when the user selects the "A CO. G. C. P. B. W. 106 g/m$^2$", the CPU 101 as a sheet information obtaining means can obtain glossiness of "30%" of the sheet used for printing. Further, e.g., when the user selects the "B CO. M. C. P. B. W. 157 g/m$^2$", the CPU 101 as the sheet information obtaining means can obtain glossiness of "6%" of the sheet used for printing.

TABLE 5

| Company | Sheet type | B.W. (g/m$^2$) | glossiness (%) | *1 Class |
|---|---|---|---|---|
| A | G.C.P. | 106 | 30 | H.G.P. |
| A | G.C.P. | 151 | 40 | H.G.P. |
| A | G.C.P. | 157 | 50 | H.G.P. |
| A | M.C.P. | 106 | 10 | L.G.P. |
| B | M.C.P. | 156 | 9 | L.G.P. |
| B | M.C.P. | 157 | 6 | L.G.P. |

*1: "H.G.P." represents highly glossy paper and "L.G.P." represents low glossy paper.

However, it can be considered that the type of the sheet set in the "CASSETTE 1" is not present in the list presented on the display 111. In that case the user can select a button B303, so that the user can access, e.g., a database which manages information prepared through the network. The user can select the type of the sheet, set in the "CASSETTE 1", from the database. As a result, the user can select the type of the sheet other than those presented in the list form.

Further, the user can manually input the glossiness of the sheets set in the "CASSETTE 1", "CASSETTE 2", and "MANUAL FEEDING TRAY". In the screen shown in FIG. 11, the user can set information on the glossiness of the set sheet by using a slider bar as shown at a portion B304. When the user sets the information on the glossiness of the sheet by using the slider bar, as shown in FIG. 11, the user can designate the information on the sheet glossiness in multiple levels (in 10 levels from 0% to 100% in FIG. 11). The input means by which the user designates, the sheet glossiness is not limited to the slider bar. For example, the MFP 100 displays in a selectable manner, at the display 111, a "button" to be selected by the user in the case where the glossiness of the sheet set by the user is high. The user selects the "button" displayed at the display 111 when the user judges that the glossiness of the set sheet is high. The information on the sheet glossiness may also be set by such a method. Thus, in the MFP 100, the user can designates the information corresponding to the glossiness of the sheet used for printing.

Figure 12:
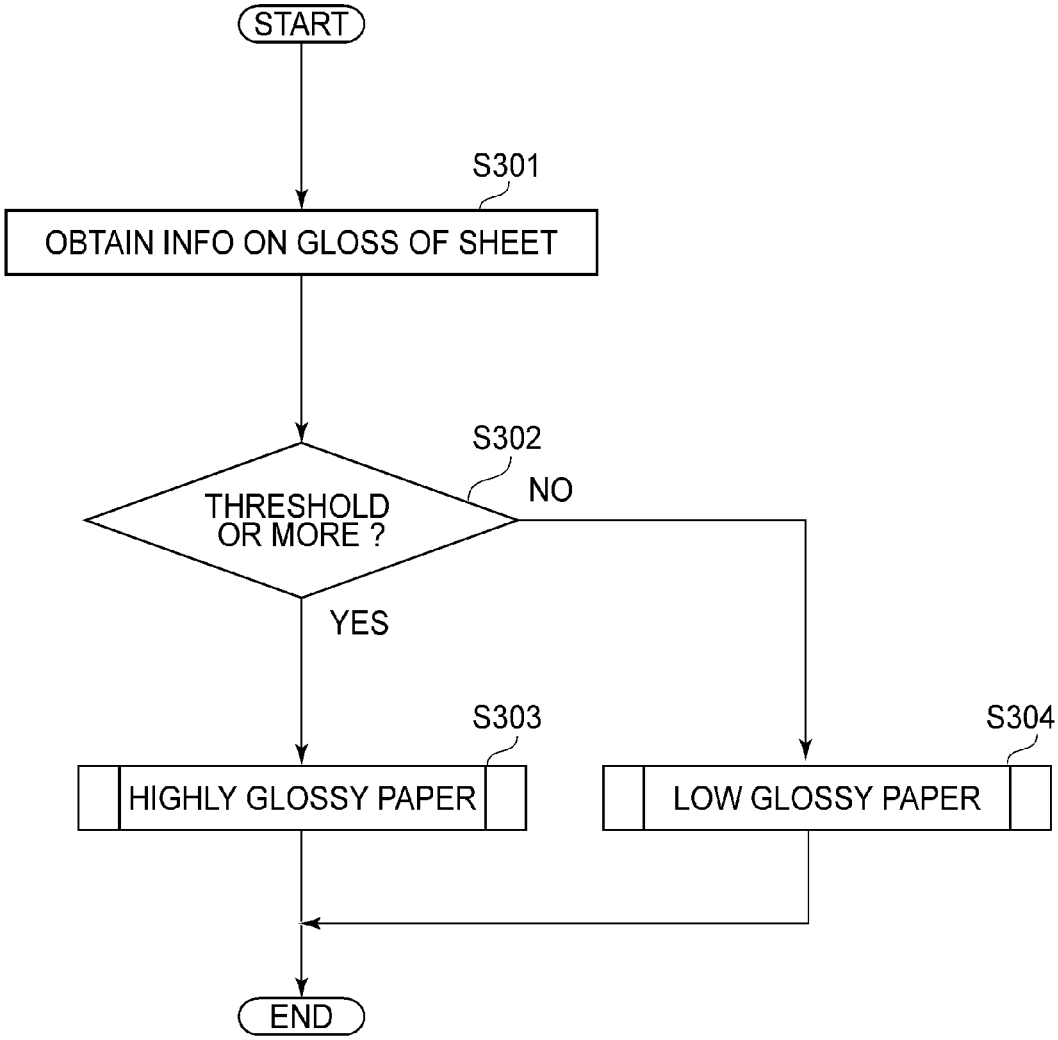
FIG. 12 is a flow chart showing a further execution procedure of image processing in the embodiment of the present invention.

In this embodiment, as shown in FIG. 11, as the sheet used for printing, the "A CO. G. C. P. B. W. 157 g/m$^2$" is used. In the case where the user wishes to reflect the settings of the sheet used for printing, the user can select a button B305 (OK button). As a result, the settings of the sheet used for printing are completed. The information set by the user in this way is stored in the RAM 102. The thus-stored information on the sheet glossiness in the RAM 102 is obtained by the CPU 101 in a step S301 of a procedure described later with reference to FIG. 12. Further, in the case where the user does not wish to reflect the settings of the sheet used for printing, the user can select a button B 306 (cancel button). As a result, the settings of the sheet used for printing are destructed.

(Operation Explanation of MFP Along Flow Chart)

An operation of the MFP depending on the information on the type of the sheet will be described below along a flow chart. Incidentally, the information on the type of the sheet has been set in advance. Further, defined processing in a step S303 corresponds to the series of the steps shown in FIG. 10. Further, defined processing in a step S304 corresponds to the series of the steps shown in FIG. 6.

S301 is a step for obtaining the information on the glossiness of the sheet. The CPU 101 as the sheet glossiness obtaining means obtains the information corresponding to the sheet glossiness designated by using the above-described screen.

S302 is a step for changing the processing depending on the information on the sheet glossiness obtained in the step S301. The CPU 101 changes the processing on the basis of the information corresponding to the obtained sheet glossiness in the step S302. In the step S302, in the case where the image forming sheet is judged as the highly glossy paper, the CPU 101 executes the processing of the step S303. Further, in the case where the image forming sheet is judged as the low glossy paper, the CPU 101 executes the processing of the step S304.

In the step S303, the defined processing to be performed when the image forming sheet is classified as the highly glossy paper in the step S301 is performed. The defined processing is the series of the steps described along the flow chart shown in FIG. 10. By performing the defined processing, the CPU 101 can generate transparent image data necessary in the case where the image forming sheet is the highly glossy paper.

In the step S304, the defined processing to be performed when the image forming sheet is classified as the low glossy paper in the step S301 is performed. The defined processing is the series of the steps described along the flow chart shown in FIG. 6. By performing the defined processing, the CPU 101 can generate transparent image data necessary in the case where the image forming sheet is the low glossy paper.

The transparent image data generated by performing the defined processing in the step S303 or in the step S304 is sent to the transparent image forming station T as the transparent image forming means. The transparent image forming station T forms the transparent image on the sheet on the basis of the received transparent image data. Further, the fixing device 10 fixes the transparent image, formed on the sheet, on the sheet.

Thus, it is possible to obtain the output product depending on the mode selected by the user, irrespective of the type of the sheet.

Embodiment 2

The image forming apparatus in this embodiment forms and fixes the color toner image on the sheet and then forms the fixes the transparent toner image on the sheet on which the color toner image has been fixed. A schematic constitution of the image forming apparatus in this embodiment will be described below. Incidentally, members or means substantially identical to those in Embodiment 1 are represented by the same reference numerals or symbols, thus being omitted from description.

(Constitution in which Transparent Single-Color Printer is Connected as Auxiliary Device)

Figure 13:
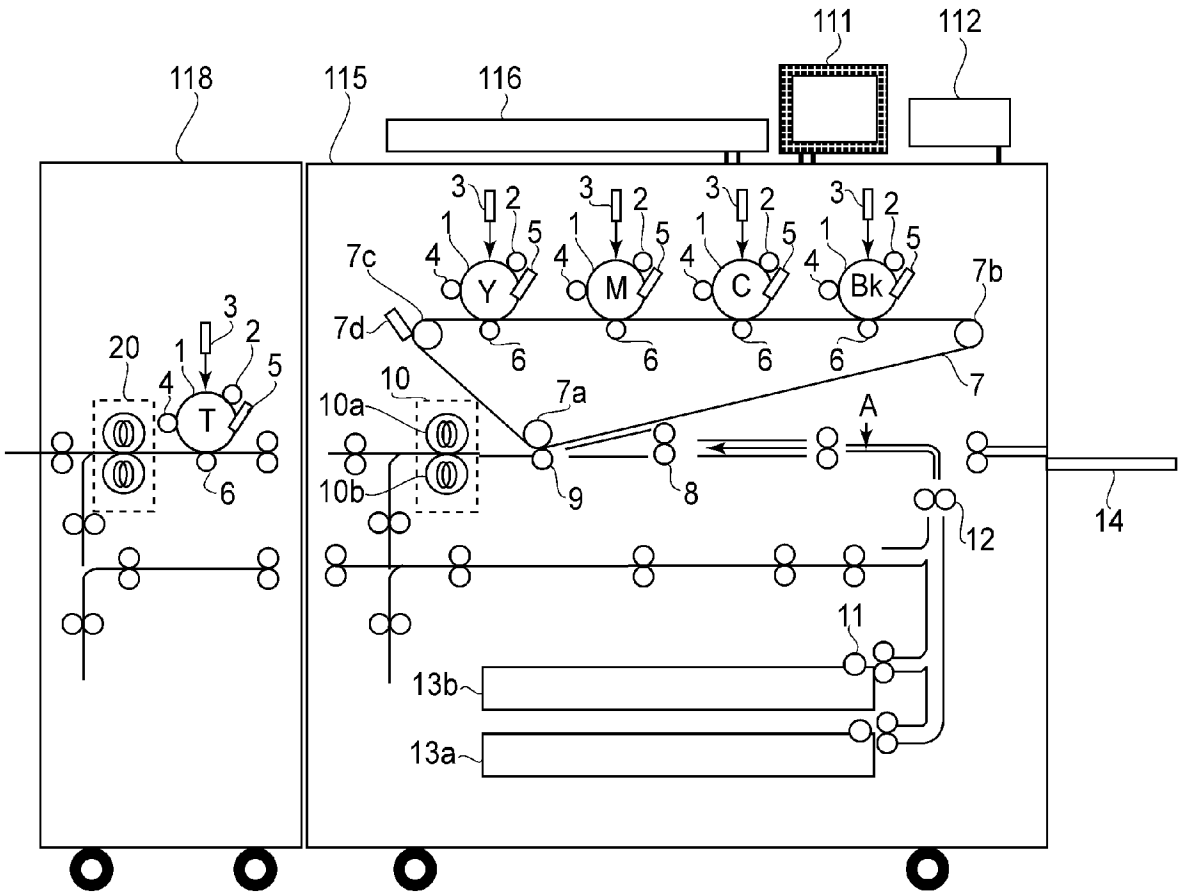
FIG. 13 is a schematic view showing the MFP in another embodiment of the present invention.

In this embodiment, the image forming apparatus as shown in FIG. 13 is used. The schematic constitution of the image forming apparatus will be described. The MFP, the controller portion, and the scanner portion have the same constitutions as those in Embodiment 1. Especially, the image forming portion of the printer portion different in constitution from Embodiment 1 will be described in detail.

Different from Embodiment 1, the main assembly of the MFP is not provided with the transparent image forming station T. Instead, a transparent single-color printer as an auxiliary device is connected to the MFP main assembly and forms the transparent toner image on the sheet conveyed from the MFP main assembly. The schematic constitution of the transparent single-color printer will be described below.

(Transparent Single-Color Printer)

The transparent single-color printer (transparent printer) includes the transparent image forming station T as the transparent image forming means and a fixing device 20 as a second fixing means. The transparent image forming station T has the substantially same constitution as that of the color image forming station Y constituting the printer portion of the MFP 100. Further, in this embodiment, the fixing device 20 for the transparent printer has the substantially same constitution as that of the fixing device 10 constituting the printer portion. Further, the control temperature and the process speed of the fixing device 20 are substantially equal to those of the fixing device 10.

The transparent image forming station T as the transparent image forming means is constituted by the photosensitive drum 1, the charger 2, the laser scanner 3, the developing device 4, the transfer roller 6, and the drum cleaner 5. The photosensitive drum 1 is electrically charged uniformly by the charger 2. The photosensitive drum 1 is exposed to light by the laser scanner 3 so that an input transparent image is formed on the uniformly charged photosensitive drum 1. As a result, the electrostatic latent image is formed on the photosensitive drum 1. The developing device 4 transfers the transparent toner onto the photosensitive drum 1 on which the electrostatic latent image is formed, thus developing the electrostatic latent image into the transparent toner image on the photosensitive drum 1. The transparent toner image formed on the photosensitive drum 1 is transferred onto the sheet on which the color image has been fixed. The drum cleaner 5 removes the so-called transfer residual toner, remaining on the photosensitive drum, which has not been transferred onto the sheet. Thus, the transparent toner image transferred onto the sheet on which the color image has been fixed. The sheet on which the transparent toner image (transparent image) is transferred is conveyed to the fixing device 20. The fixing device 20 fixes the transparent image formed on the conveyed sheet.

Here, when the transparent image is formed, the transparent printer forms and fixes the transparent image of the transparent toner. Further, when the transparent image is not formed, the transparent printer includes a path for permitting discharge of the sheet toward the outside of the image forming apparatus without conveying the sheet to the transparent image forming station T. The above is the description of the apparatus used for image formation in this embodiment.

(Relationship Between Toner Amount and Glossiness)

Figure 14:
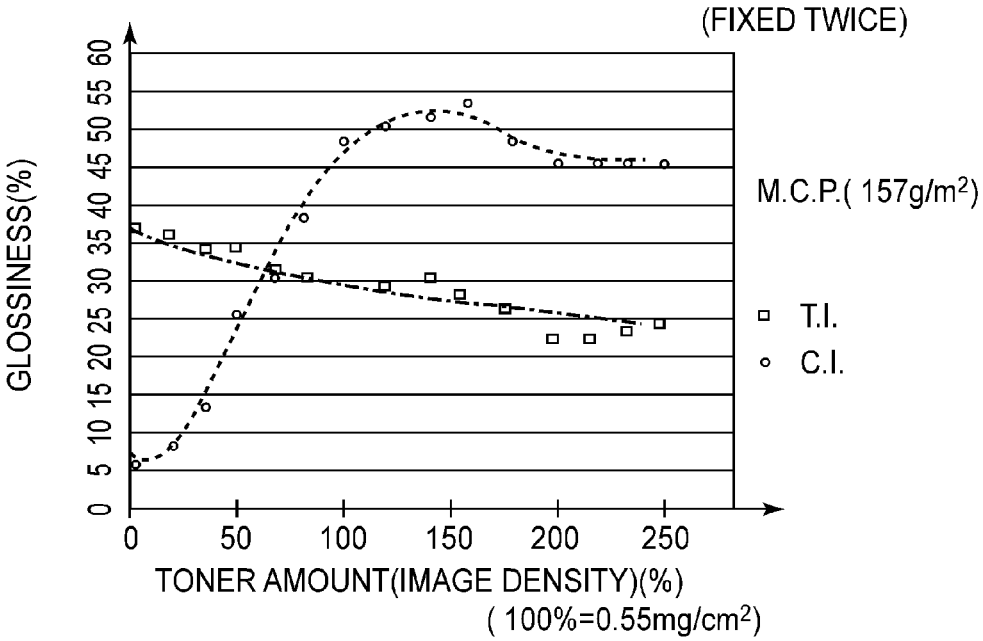
FIG. 14 is a graph showing a relationship between a change in toner amount and a change in glossiness with respect to low glossy paper.
Figure 15:
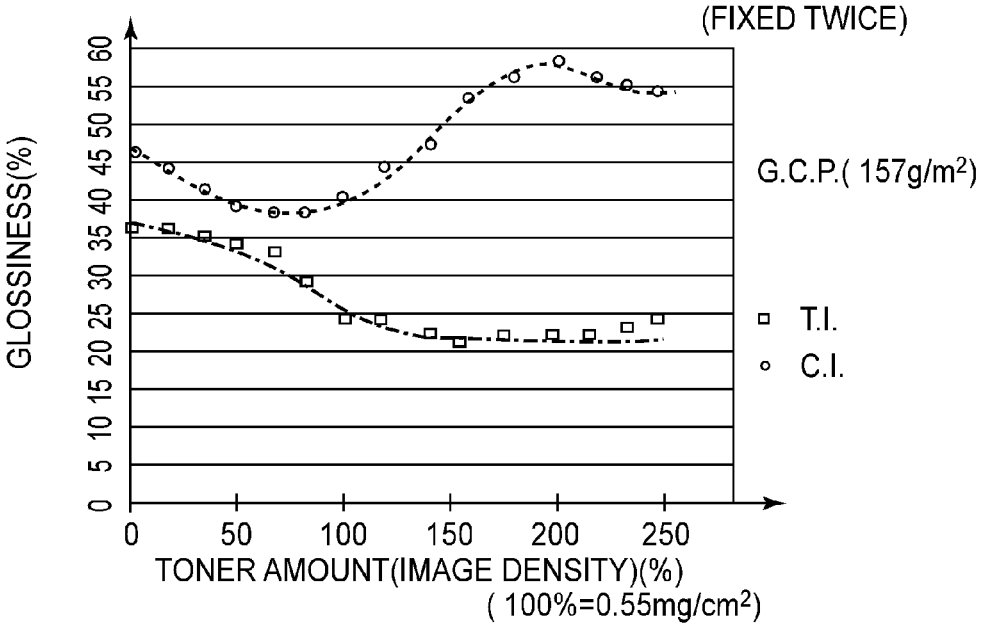
FIG. 15 is a graph showing a relationship between a change in toner amount and a change in glossiness with respect to highly glossy paper.

The relationship between the toner amount and the glossiness with respect to a print to be output by using the above-described image forming apparatus (in this embodiment) will be described below. FIGS. 14 and 15 are graphs each showing the relationship between the amount per unit area of the toner subjected to fixation on the sheet surface and the glossiness of the sheet surface on which the toner images are fixed. FIG. 14 is the graph in the case where the sheet on which the toner images are fixed is the matt coated paper as the low glossy paper. Further, FIG. 15 is the graph in the case where the sheet on which the toner images are fixed is the gloss coated paper as the highly glossy paper. The respective cases will be described specifically below.

(Relationship Between Toner Amount and Glossiness: Matt Coated Paper)

FIG. 14 is the graph showing the relationship between the amount per unit area of the toner subjected to fixation on the sheet surface and the glossiness of the toner images fixed on the sheet. As the sheet on which the toner images are fixed, the matt coated paper ("U-light"; basis weight=157 g/m$^2$) as the low glossy paper is used. In the graph of FIG. 14, the ordinate represents the 60° C.-glossiness and the abscissa represents the toner amount per unit area. Incidentally, the toner amount is represented by a conversion value (%) such that a maximum amount per unit area of 0.55 mg/cm$^2$ is taken as 100% for each of the color toner and the transparent toner.

A curve indicated by a broken line in the graph of FIG. 14 represents the glossiness at a portion where the color toner image is formed on the matt coated paper and fixed by the fixing device 10 and then is heated (fixed) again by the fixing device 20. A curve indicated by a chain line in the graph of FIG. 14 represents the glossiness at a portion where the color toner image formed on the matt coated paper and fixed by the fixing device 10 and then the transparent toner image is formed in a 70%-toner amount (0.39 mg/cm$^2$) so as to cover the fixed color toner image and is fixed by the fixing device 20.

For example, when the toner amount (the abscissa of FIG. 14) is 150%, the color toner image is formed in a 150%-toner amount. The toner image formed on the sheet is fixed by the fixing device 10. Here, at the portion where the transparent toner image is not formed, the sheet is heated again by the fixing device 20, so that the glossiness is 51%. Further, at the portion where the transparent toner image is formed in the 70%-toner amount so as to cover the color toner image, the transparent toner image is fixed on the sheet by the fixing device 20, so that the glossiness is 29%.

Incidentally, the curve indicated by the chain line shown in FIG. 14 represents the glossiness when the transparent toner image is formed on the sheet in a constant amount, i.e., 70%-toner amount (0.39 mg/cm$^2$). For that reason, the curve indicated by the broken line shows, when the abscissa (the toner amount) is 0%, the glossiness (6%) of the sheet on which both of the color toner image and the transparent toner image are not formed. Further, the curve indicated by the chain line shows the glossiness at the time when the transparent toner image is formed in the 70%-toner amount on the sheet.

With respect to the portion (the curve of the broken line) where the transparent toner image is not formed so as to cover the color toner image, the surface of the color toner image is subjected to application of heat two times by the fixing devices. However, with respect to the portion (the curve of the chain line), heat quantity is provided only one time to the transparent toner layer as the surface layer. For that reason, there is a tendency that the glossiness at the portion covered with the transparent toner is less liable to be increased.

Incidentally, the graph of FIG. 14 is prepared under the following condition. The process speed is 250 mm/sec. Further, a control target temperature of the fixing roller of the fixing device 10 is 155° C. and the control target temperature of the fixing roller of the fixing device 20 is also 155° C.

(Relationship Between Toner Amount and Glossiness: Gloss Coated Paper)

FIG. 14 is the graph showing the relationship between the amount per unit area of the toner subjected to fixation on the sheet surface and the glossiness of the toner images fixed on the sheet. As the sheet on which the toner images are fixed, the gloss coated paper ("Golden Cast Super Art"; basis weight=157 g/m$^2$) as the highly glossy paper is used. In the graph of FIG. 15, the ordinate represents the 60° C.-glossiness and the abscissa represents the toner amount per unit area. Incidentally, the toner amount is represented by a conversion value (%) such that a maximum amount per unit area of 0.55 mg/cm$^2$ is taken as 100% for each of the color toner and the transparent toner.

A curve indicated by a broken line in the graph of FIG. 15 represents the glossiness at a portion where the color toner image is formed on the gloss coated paper and fixed by the fixing device 10 and then is heated (fixed) again by the fixing device 20. A curve indicated by a chain line in the graph of FIG. 15 represents the glossiness at a portion where the color toner image formed on the gloss coated paper and fixed by the fixing device 10 and then the transparent toner image is formed in a 70%-toner amount (0.39 mg/cm$^2$) so as to cover the fixed color toner image and is fixed by the fixing device 20.

For example, when the toner amount (the abscissa of FIG. 15) is 150%, the color toner image is formed in a 150%-toner amount. The toner image formed on the sheet is fixed by the fixing device 10. Here, at the portion where the transparent toner image is not formed, the sheet is heated again by the fixing device 20, so that the glossiness is 47%. Further, at the portion where the transparent toner image is formed in the 70%-toner amount so as to cover the color toner image, the transparent toner image is fixed on the sheet by the fixing device 20, so that the glossiness is 22%.

Incidentally, the curve indicated by the chain line shown in FIG. 15 represents the glossiness when the transparent toner image is formed on the sheet in a constant amount, i.e., 70%-toner amount (0.39 mg/cm$^2$). For that reason, the curve indicated by the broken line shows, when the abscissa (the toner amount) is 0%, the glossiness (47%) of the recording sheet on which both of the color toner image and the transparent toner image are not formed. However, the curve indicated by the chain line shows the glossiness at the time when the transparent toner image is formed in the 70%-toner amount on the sheet.

Incidentally, the graph of FIG. 15 is prepared under the following condition. The process speed is 250 mm/sec. Further, a control target temperature of the fixing roller of the fixing device 10 is 155° C. and the control target temperature of the fixing roller of the fixing device 20 is also 155° C. The control target temperature of the fixing rollers of the fixing device 10 and the fixing device 20 are not limed to the same value. Further, the glass transition point Tg of the color toner used and the transparent toner used is 55° C.

The schematic constitution of the MFP as the image forming apparatus and the transparent printer as the transparent image forming device which are used in this embodiment is as described above. The glossiness cannot be increased only by forming the transparent image in the area in which the glossiness is intended to be increased by using such devices (apparatuses). For that reason, in this embodiment, the apparatuses are controlled in accordance with a flow chart shown below in order to increase the glossiness in the area, designated by the user, in which the glossiness is intended to be increased. Data in the above-described graphs each showing the relationship between the toner amount and the glossiness vary depending on the type of the image forming sheet, the environmental condition, the type of the toner used for image formation, the process speed, and the like. For that reason, the relationship, between the toner amount and the glossiness, used for the control is stored in the form of an LUT (look-up table).

(Image Processing of MFP Along Flow Chart)

Also in this embodiment, similarly as in Embodiment 1, the area in which the transparent image is to be formed may preferably be changed depending on the type of the sheet. For that purpose, the CPU 101 controls the MFP 100 so as to be operated in accordance with the flow chart shown in FIG. 12.

Figure 16:
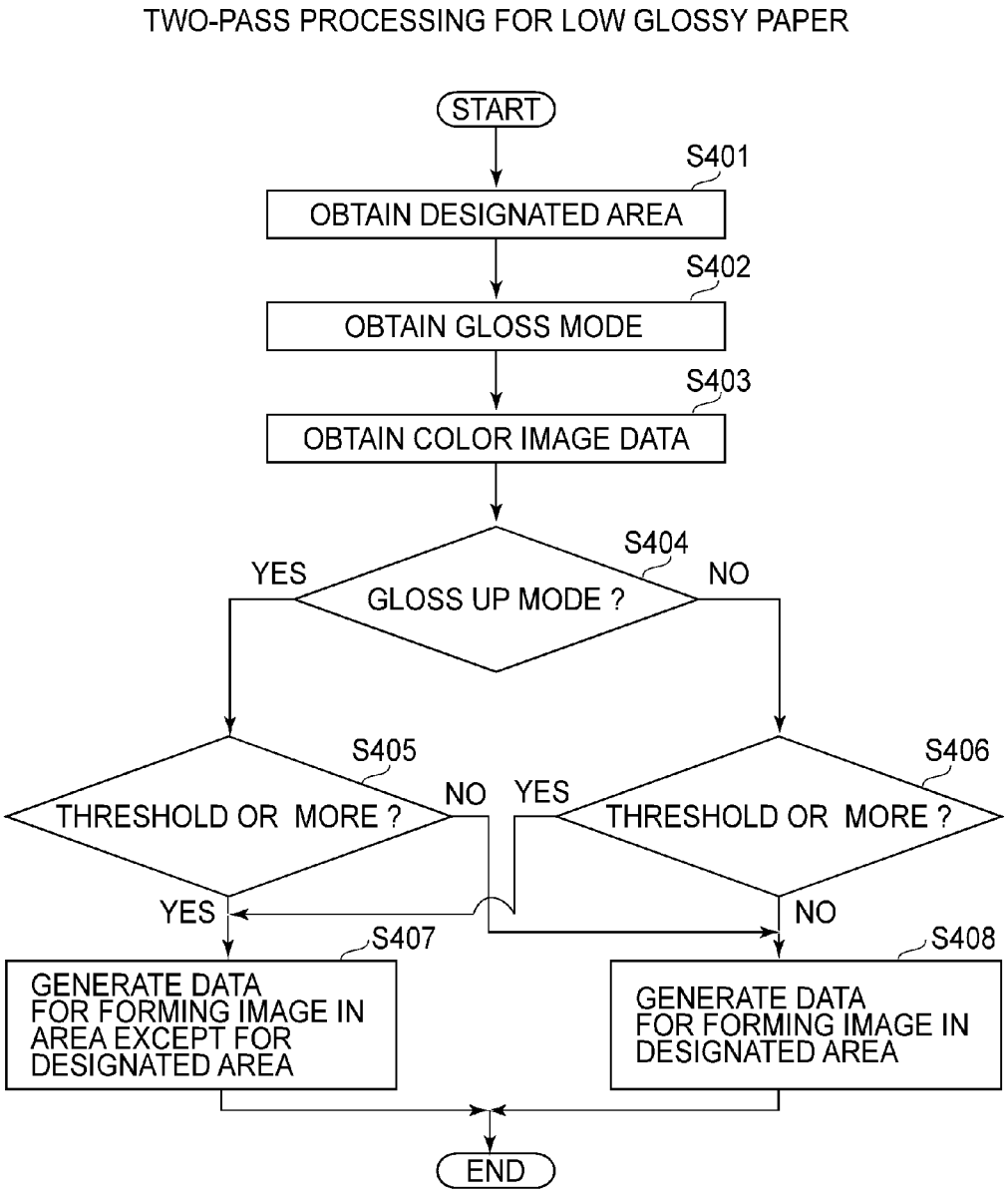
FIG. 16 is a flow chart showing an execution procedure of image processing in the aforementioned another embodiment of the present invention.

However, in this embodiment, the contents of the defined processing performed in the step S304 is different from that in Embodiment 1 and a series of steps shown in FIG. 16 is performed as the defined processing. This is because, in order to perform the output depending on the mode, in the case where the image forming sheet is the matt coated paper, it is preferable that the print of the color image to be fixed on the sheet is taken into account.

Incidentally, in the case where the image forming sheet is the gloss coated paper, i.e., in the case of the defined processing performed in the step S303, the series of the steps shown in FIG. 10 is performed as the defined processing similarly as in Embodiment 1. The operation in the case of the highly glossy paper is identical to that along the flow chart shown in FIG. 10.

Details of the defined processing performed in the step S304 in the constitution in which the fixation of the color toner image and the fixation of the transparent toner image are separated from each other will be described along a flow chart.

(Defined Processing in Case of Low Glossy Paper)

FIG. 16 is a flow chart showing an operation of the MFP 100 when the image forming sheet is the low glossy paper. A flow of transparent image data generation executed in this embodiment as the defined processing performed in the step S304 in FIG. 12 will be described below along the flow chart.

S401 represents a step for obtaining the area, in which the glossiness is intended to be adjusted, designated by the user. The CPU 101 as an area obtaining means obtains information designating the area in which the glossiness is to be adjusted.

S402 represents a step for obtaining a mode. The CPU 101 as a mode obtaining means obtains mode information designated by the user. The CPU 101 obtains information on "GLOSS UP MODE" (first mode) in which the glossiness in the area obtained in the step S401 is relatively increased or "GLOSS DOWN MODE" (second mode) in which the glossiness is relatively decreased.

S403 represents a step for obtaining data of the color image to be formed on the sheet. The CPU 101 as a color image data obtaining means for obtaining the density of the color image obtains the image data used for forming the color image on the sheet.

S404 represents a step for determining transparent image data, for forming an image with the transparent toner, generated on the basis of the mode information obtained in the step S402. The CPU 101 executes processing in a step S405 when the mode information obtained in the step S402 is the "GLOSS UP MODE". Further, the CPU 101 executes processing in a step S406 when the mode information obtained in the step S402 is the "GLOSS DOWN MODE".

S405 is a step performed when the "GLOSS UP MODE" is selected. As described above, with respect to the low glossy paper, it is preferable that the density of the color image to be formed on the sheet is taken into account. Therefore, in the case where the color image density obtained in the step S403 is a certain threshold or more, the CPU 101 executes a step S407 in order to increase the glossiness in the area designated by the user. Further, in the case where the color image density obtained in the step S403 is less than the certain threshold, the CPU 101 executes a step S408 in order to increase the glossiness in the area designated by the user.

S406 is a step performed when the "GLOSS DOWN MODE" is selected. In the case where the color image density obtained in the step S403 is a certain threshold or more, the CPU 101 executes a step S407 in order to decrease the glossiness in the area designated by the user. Further, in the case where the color image density obtained in the step S403 is less than the certain threshold, the CPU 101 executes a step S408 in order to decrease the glossiness in the area designated by the user.

S407 represents a step for generating the transparent image data by the CPU 101 as the transparent image generating means. The CPU 101 as the transparent image data generating means generates the transparent image data for forming the transparent toner image in an image formable area except for the area, the gloss is intended to be adjusted, obtained in the step S101.

S408 is a step for generating the transparent image data by the CPU 101 as the transparent image generating means. The CPU 101 as the transparent image generating means generates the transparent image data for forming the transparent toner image in the area, in which the glossiness is intended to be adjusted, obtained in the step S401.

Thus, the transparent image data generated in the step S407 or in the step S408 is sent to the transparent image forming station T.

As a result, when the "GLOSS UP MODE" is selected by the user, it is possible to relatively increase the glossiness in the area, in which the glossiness is intended to be adjusted, designated by the user. Further, when the "GLOSS DOWN MODE" is selected by the user, it is possible to relatively decrease the glossiness in the area, in which the glossiness is intended to be adjusted, designated by the user.

(Glossiness of Output Product)

Figure 17:
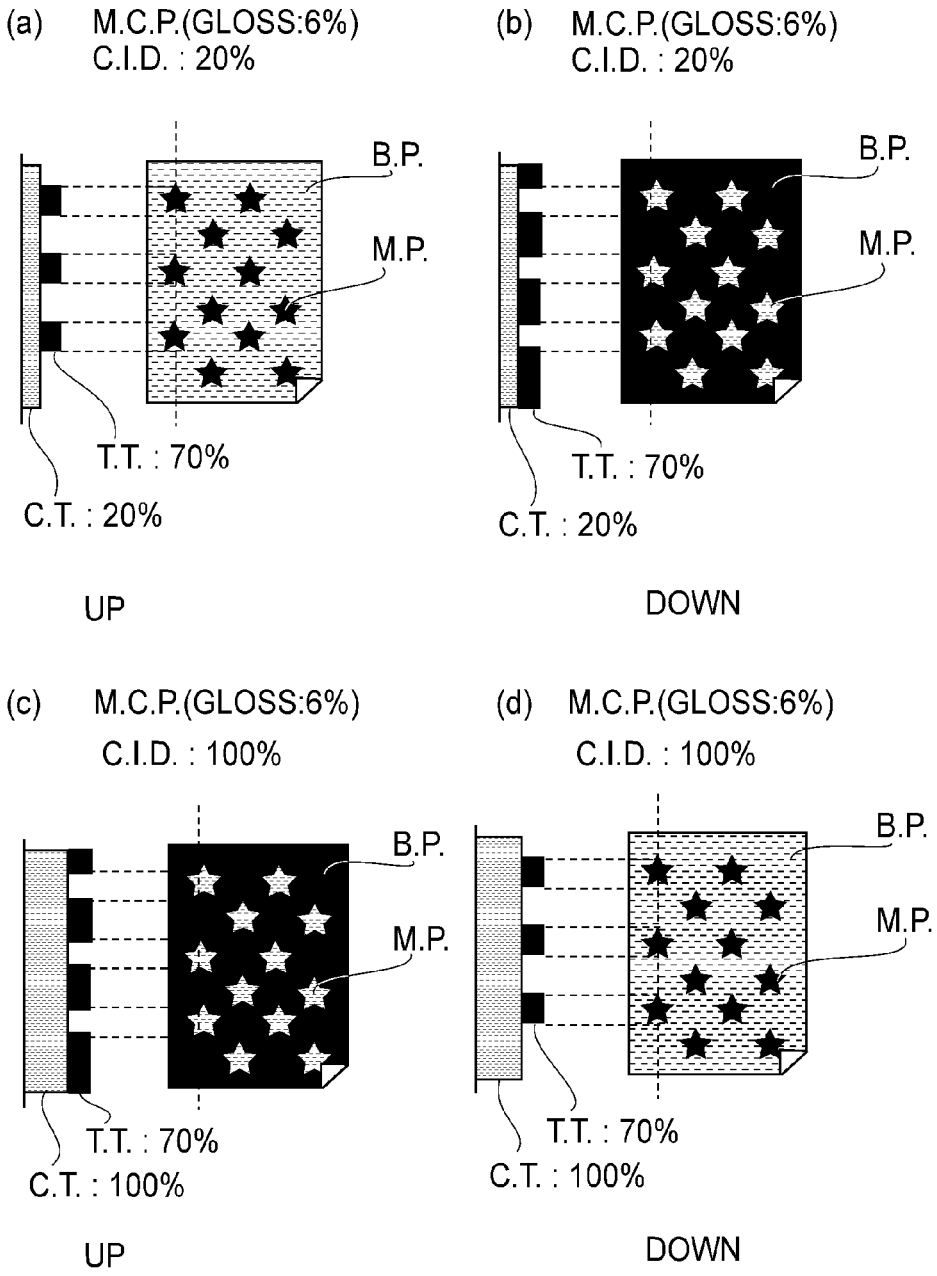
FIGS. 17(*a*) to 17(*d*) and FIGS. 18(*a*) to 18(*d*) are schematic views for illustrating an image to be processed by and a print to be output by an image forming apparatus in the aforementioned another embodiment of the present invention.

The glossiness output by the print output when the image forming apparatus is operated along the above-described flow chart will be described below while being associated with schematic image views. FIGS. 17(*a*) to 17(*d*) and FIGS. 18(*a*) to 18(*d*) are schematic image views for illustrating prints to be output by the image forming apparatus.

TABLE 6

| | | M.P. | B.P. |
|---|---|---|---|
| Image Density signal (%) | Color | 20 | 20 |
| | Transparent | 70 | 0 |
| Toner amount ($mg/cm^2$) | | 0.50 | 0.11 |
| 60°-glossiness (%) | | 36 | 8 |

Table 6 shows the glossiness at the marked portion (★ portion) and the glossiness at the background portion with respect to the printer product shown in FIG. 17(*a*)).

Here, the glossiness at the marked portion where the toner image was formed on the matt coated paper with 90%-density is 36% and the glossiness at the background portion where the toner image was formed on the matt coated paper with 20%-density is 8% (on the basis of the relationship shown in FIG. 14).

For that reason, the glossiness of 36% at the marked portion is higher than the glossiness of 8% at the background portion. As a result, with respect to the matt coated paper as the low glossy paper, the marked portion glossiness can be made relatively higher than the background portion glossiness.

TABLE 7

| | | M.P. | B.P. |
|---|---|---|---|
| Image Density signal (%) | Color | 20 | 20 |
| | Transparent | 0 | 70 |
| Toner amount ($mg/cm^2$) | | 0.11 | 0.50 |
| 60°-glossiness (%) | | 8 | 36 |

Table 7 shows the glossiness at the marked portion (★ portion) and the glossiness at the background portion with respect to the printer product shown in FIG. 17(*b*)).

Here, the glossiness at the marked portion where the toner image was formed on the matt coated paper with 20%-density is 8% and the glossiness at the background portion where the toner image was formed on the matt coated paper with 90%-density is 36% (on the basis of the relationship shown in FIG. 14).

For that reason, the glossiness of 8% at the marked portion is lower than the glossiness of 36% at the background portion. As a result, with respect to the matt coated paper as the low glossy paper, the marked portion glossiness can be made relatively lower than the background portion glossiness.

TABLE 8

| | | M.P. | B.P. |
|---|---|---|---|
| Image density signal (%) | Color | 100 | 100 |
| | Transparent | 0 | 70 |
| Toner amount ($mg/cm^2$) | | 0.50 | 0.94 |
| 60°-glossiness (%) | | 49 | 29 |

Table 8 shows the glossiness at the marked portion (★ portion) and the glossiness at the background portion with respect to the printer product shown in FIG. 17(*c*)).

Here, the glossiness at the marked portion where the toner image was formed on the matt coated paper with 170%-density is 49% and the glossiness at the background portion where the toner image was formed on the matt coated paper with 100%-density is 29% (on the basis of the relationship shown in FIG. 14).

For that reason, the glossiness of 49% at the marked portion is higher than the glossiness of 29% at the background portion. As a result, with respect to the matt coated paper as the low glossy paper, the marked portion glossiness can be made relatively higher than the background portion glossiness.

TABLE 9

| | | M.P. | B.P. |
|---|---|---|---|
| Image Density signal (%) | Color | 100 | 100 |
| | Transparent | 70 | 0 |
| Toner amount ($mg/cm^2$) | | 0.94 | 0.55 |
| 60°-glossiness (%) | | 29 | 49 |

Table 9 shows the glossiness at the marked portion (★ portion) and the glossiness at the background portion with respect to the printer product shown in FIG. 17(*d*)).

Here, the glossiness at the marked portion where the toner image was formed on the matt coated paper with 170%-density is 29% and the glossiness at the background portion where the toner image was formed on the matt coated paper with 100%-density is 49% (on the basis of the relationship shown in FIG. 14).

For that reason, the glossiness of 29% at the marked portion is lower than the glossiness of 49% at the background portion. As a result, with respect to the matt coated paper as the low glossy paper, the marked portion glossiness can be made relatively lower than the background portion glossiness.

TABLE 10

| | | M.P. | B.P. |
|---|---|---|---|
| Image density signal (%) | Color | 20 | 20 |
| | Transparent | 0 | 70 |
| Toner amount ($mg/cm^2$) | | 0.11 | 0.50 |
| 60°-glossiness (%) | | 44 | 37 |

Figure 18:
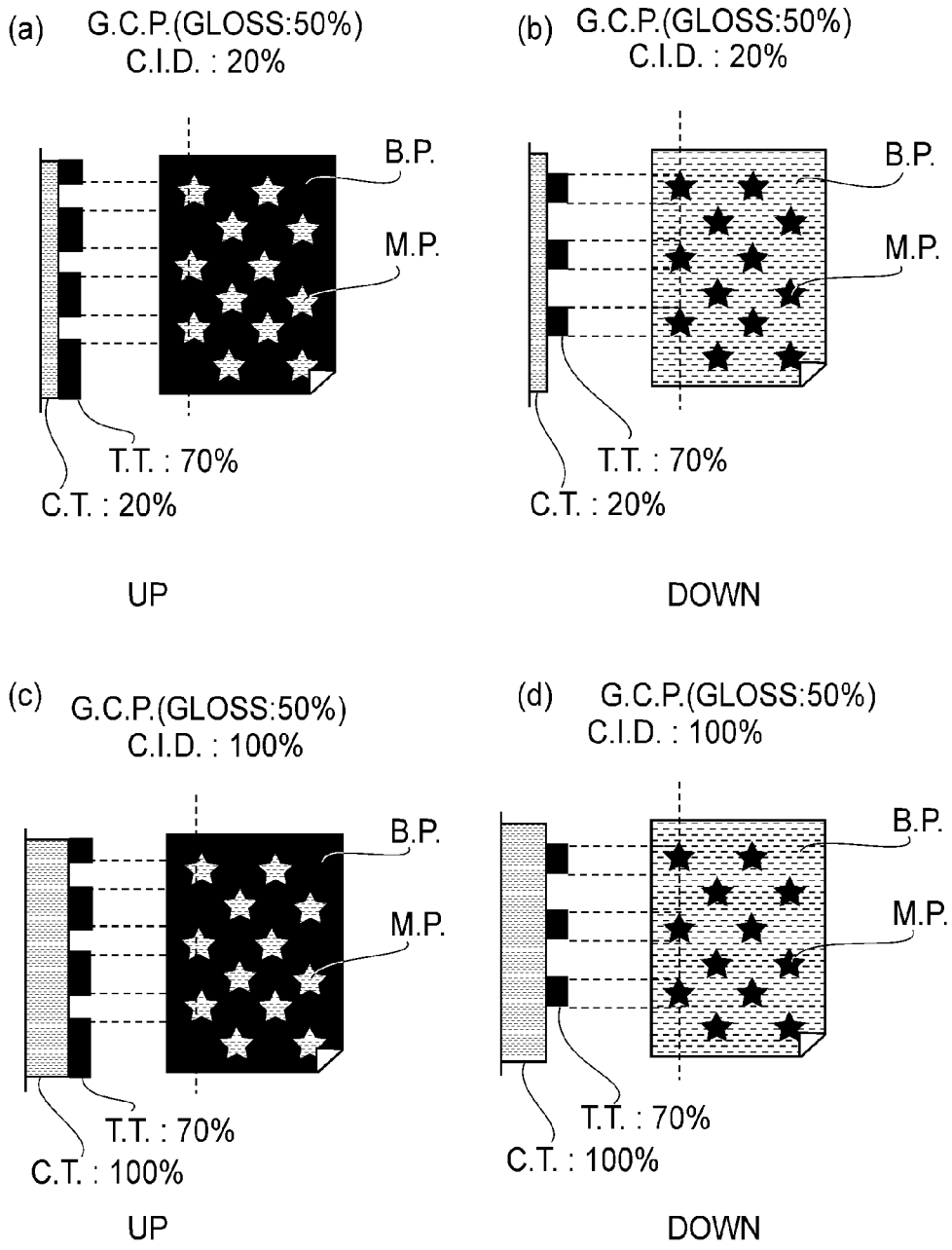

Table 10 shows the glossiness at the marked portion (★ portion) and the glossiness at the background portion with respect to the printer product shown in FIG. 18(*a*)).

Here, the glossiness at the marked portion where the toner image was formed on the gloss coated paper with 20%-density is 44% and the glossiness at the background portion where the toner image was formed on the matt coated paper with 90%-density is 37% (on the basis of the relationship shown in FIG. 15).

For that reason, the glossiness of 44% at the marked portion is higher than the glossiness of 37% at the background portion. As a result, with respect to the gloss coated paper as the highly glossy paper, the marked portion glossiness can be made relatively higher than the background portion glossiness.

TABLE 11

| | | M.P. | B.P. |
|---|---|---|---|
| Image density signal (%) | Color | 20 | 20 |
| | Transparent | 70 | 0 |
| Toner amount ($mg/cm^2$) | | 0.50 | 0.11 |
| 60°-glossiness (%) | | 37 | 44 |

Table 11 shows the glossiness at the marked portion (★ portion) and the glossiness at the background portion with respect to the printer product shown in FIG. 18(*b*)).

Here, the glossiness at the marked portion where the toner image was formed on the gloss coated paper with 90%-density is 37% and the glossiness at the background portion where the toner image was formed on the matt coated paper with 20%-density is 44% (on the basis of the relationship shown in FIG. 15).

For that reason, the glossiness of 37% at the marked portion is lower than the glossiness of 44% at the background portion. As a result, with respect to the gloss coated paper as the highly glossy paper, the marked portion glossiness can be made relatively lower than the background portion glossiness.

TABLE 12

| | | M.P. | B.P. |
|---|---|---|---|
| Image Density signal (%) | Color | 100 | 100 |
| | Transparent | 0 | 70 |
| Toner amount ($mg/cm^2$) | | 0.55 | 0.94 |
| 60°-glossiness (%) | | 41 | 25 |

Table 12 shows the glossiness at the marked portion (★ portion) and the glossiness at the background portion with respect to the printer product shown in FIG. 18(*c*)).

Here, the glossiness at the marked portion where the toner image was formed on the gloss coated paper with 100%-density is 41% and the glossiness at the background portion where the toner image was formed on the matt coated paper with 170%-density is 25% (on the basis of the relationship shown in FIG. 15).

For that reason, the glossiness of 41% at the marked portion is higher than the glossiness of 25% at the background portion. As a result, with respect to the gloss coated paper as the highly glossy paper, the marked portion glossiness can be made relatively higher than the background portion glossiness.

TABLE 13

| | | M.P. | B.P. |
|---|---|---|---|
| Image Density signal (%) | Color | 100 | 100 |
| | Transparent | 70 | 0 |
| Toner amount (mg/cm$^2$) | | 0.94 | 0.55 |
| 60°-glossiness (%) | | 25 | 41 |

Table 13 shows the glossiness at the marked portion ( ★ portion) and the glossiness at the background portion with respect to the printer product shown in FIG. 18(*d*)).

Here, the glossiness at the marked portion where the toner image was formed on the gloss coated paper with 170%-density is 25% and the glossiness at the background portion where the toner image was formed on the matt coated paper with 100%-density is 41% (on the basis of the relationship shown in FIG. 15).

For that reason, the glossiness of 25% at the marked portion is lower than the glossiness of 41% at the background portion. As a result, with respect to the gloss coated paper as the lower glossy paper, the marked portion glossiness can be made relatively higher than the background portion glossiness.

Thus, in accordance with the mode selected by the user, the glossiness in the area in which the glossiness is intended to be adjusted by the user can be relatively increased or relatively decreased.

Incidentally, such a status that the transparent toner image is formed so as to cover the color toner image and is the fixed can also arise in the image forming apparatus described in Embodiment 1. That is, the status can also arise by forming and fixing only the color image on the sheet and then placing the sheet discharged to the outside of the image forming apparatus on the manual feeding tray. Further, the status can also arise by providing a flapper (a means for switching the sheet conveying direction), for circulating the sheet so that the transparent toner image can be formed again on the surface of the sheet on which the color image has been formed, to the image forming apparatus described in Embodiment 1. For that reason, a similar effect can be obtained by executing the control as described above also in the case of such constitutions.

Embodiment 3

Figure 19:
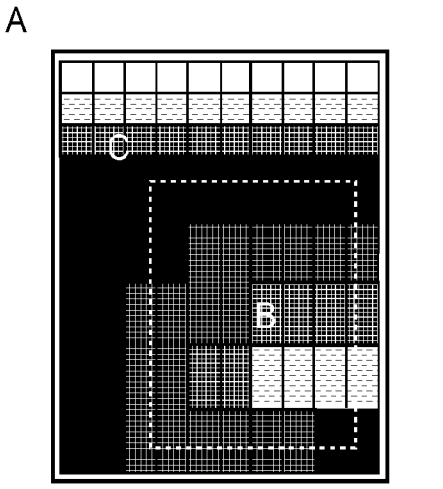
FIGS. 19(*a*) and 19(*b*) are schematic views showing an image for illustrating a density distribution of color image data and showing a matrix for illustrating a data structure.

In Embodiment 2, the constitution in which the color image is uniformly formed in the constant toner amount on the entire surface of the sheet is described by enumerating several examples. In this embodiment, the constitution thereof will be described by using an example in which the color image having a density distribution as shown in FIGS. 19(*a*) and 19(*b*) is formed on the sheet. Incidentally, members or means substantially identical to those in Embodiments 1 and 2 are represented by the same reference numerals or symbols, thus being omitted from description.

(Density Distribution and Glossiness Distribution of Color Image with Non-Uniform Density)

FIGS. 19(*a*) and 19(*b*) are schematic views showing the density distribution of the color image data. Specifically, FIG. 19(*a*) is a schematic view of an image showing the data and the density. Further, FIG. 19(*b*) is a schematic view showing a data structure indicating the data as numerical values in a matrix form. Here, the area indicating the entire image area of the image shown in FIG. 19(*a*) is referred to as area A. Further, in the image shown in FIG. 19(*a*), the area in which the glossiness is intended to be increased is referred to as area B. Further, in the image shown in FIG. 19(*a*), the area except for the area in which the glossiness is intended to be increased is referred to as area C.

When the color image has the density distribution as shown in FIGS. 19(*a*) and 19(*b*), the CPU 101 determines the area in which the transparent toner image is to be formed.

The CPU 101 converts the density distribution of the color image into the glossiness distribution of the color image in order to determine the area in which the transparent toner image is to be formed. A relationship used for the conversion depends on the constitution of the image forming apparatus. In this embodiment, the image forming apparatus described in Embodiment 2 is used. For that reason, the glossiness is converted on the basis of the relationship between the toner amount and the glossiness shown in FIGS. 14 and 15. When the glossiness is calculated on the basis of the toner amount of the image formed on the sheet, the CPU 101 calculates the glossiness by using the LUT. Incidentally, the glossiness may also be calculated by utilizing a polynomial expression indicating a curve obtained by polynomial approximation from the data shown in FIGS. 14 and 15.

The CPU 101 calculates the data corresponding to the glossiness distribution when the transparent toner image is selectively formed in the area B, on the basis of the data corresponding to the density distribution of the color image data. Further, similarly, the CPU 101 calculates the data corresponding to the glossiness distribution when the transparent toner image is selectively formed in the area C, on the basis of the data corresponding to the density distribution of the color image data.

FIG. 20(*a*) is a schematic view showing the glossiness distribution when the transparent toner image is formed in the area C with 70%-density. Similarly, FIG. 20(*b*) is a schematic view showing the glossiness distribution when the transparent toner image is formed in the area B with 70%-density. The CPU 101 can obtain the data indicating the glossiness distribution when the transparent toner image is formed in the area B and that when the transparent toner image is formed in the area C.

In the following, the CPU 101 selectively forms the transparent toner image in either one of the area B and the area C on the basis of the density distribution of the color image shown in FIG. 20(*a*) or 20(*b*). An operation for determining the area in which the transparent toner image is to be formed will be described below along the flow chart.

(Operation Explanation of MFP Along Flow Chart)

The operation of the MFP in the case where the color image has the density distribution shown in FIGS. 19(*a*) and 19(*b*) will be described along the flow chart.

Figure 21:
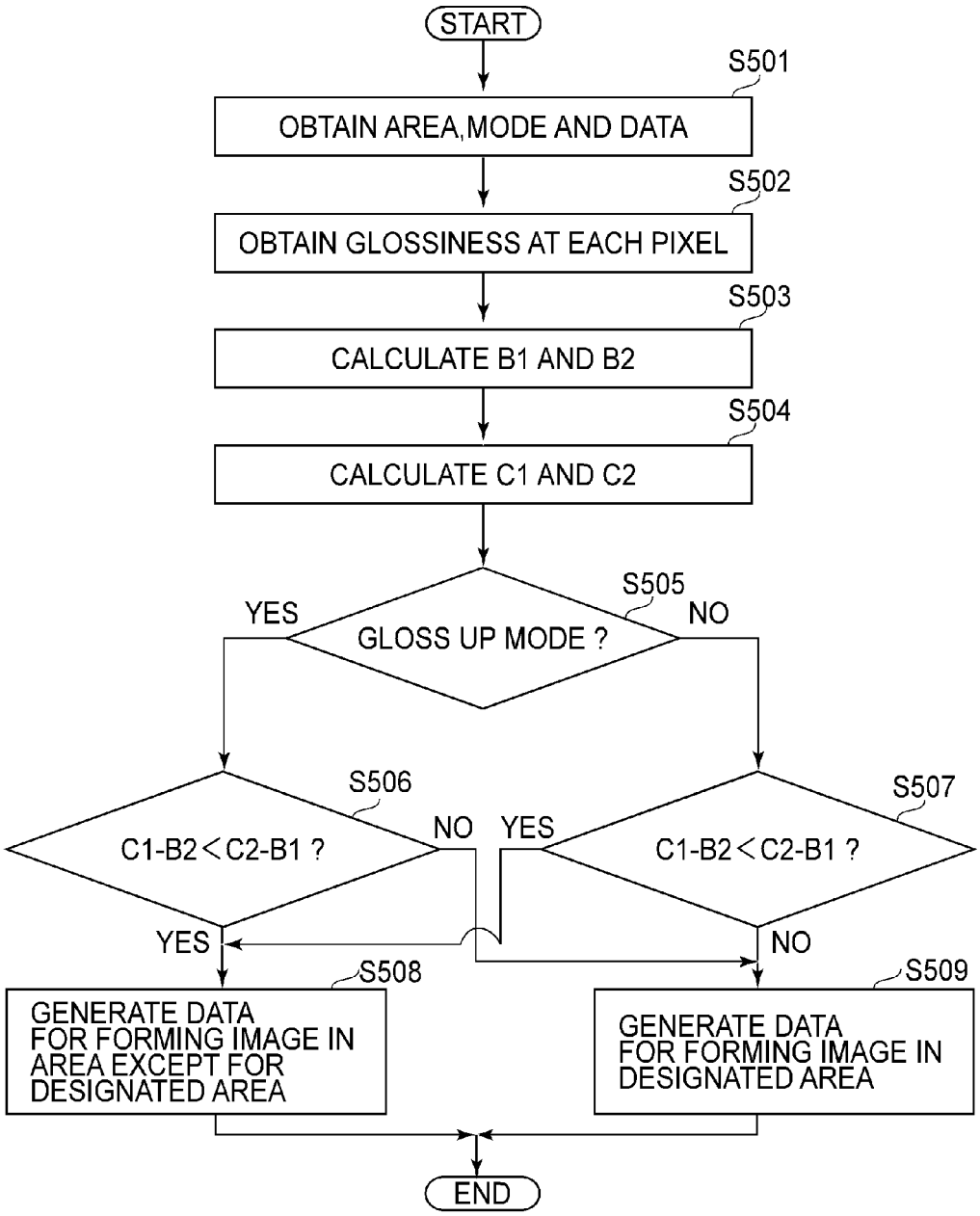
FIG. 21 is a flow chart showing another execution procedure of image processing in a further embodiment of the present invention.

FIG. 21 is the flow chart for explaining the operation of the MFP. The CPU 101 controls the MFP 100 in accordance with the program stored in the ROM 103 so that the MFP 100 can be operated in accordance with the flow chart.

Also in this embodiment, similarly as in Embodiment 1, the information on the type of the sheet, the color image data, and the information indicating the area in which the glossiness is intended to be adjusted have been set in advance.

S501 is a step for obtaining the area, in which the glossiness is intended to be adjusted, the mode, and the color image data. The CPU 101 stores these pieces of the information in the RAM 102.

S502 is a step for converting the color image data into the glossiness. The CPU 101 converts the color image data, i.e., the density data at each pixel, into the glossiness in the case where the transparent toner image is fixed and in the case where the transparent toner image is not fixed. In this step, the CPU 101 uses the LUT stored in the ROM 102.

S503 is a step for evaluating the glossiness converted from the density data at each pixel corresponding to the area in which the glossiness is intended to be adjusted (the area B shown in FIG. 19(*a*)).

The user (person) recognizes a graphic pattern by recognizing a boundary. For that reason, in order to cause the user to recognize the graphic pattern on the basis of the glossiness difference, it is preferable that the boundary of the graphic pattern and adjusted so as to increase the glossiness difference at the boundary portion.

That is, when the area in which the transparent toner image is to be formed is determined, the data in the neighborhood of the boundary is important. Therefore, in this embodiment, in order to place importance on the data in the neighborhood of the boundary, an evaluation value is opened by using a weighted average method in which weighting in the neighborhood of the boundary area (portion) is large. By using the weighed average method, the evaluation value for placing importance on the data corresponding to the glossiness in the neighborhood of the boundary is calculated, so that the glossiness difference liable to be recognized by human eyes. Incidentally, the evaluation value calculating method may be another calculating method. The evaluation value is a numerical value used when the transparent toner image is generated. In this embodiment, a unit of the evaluation value is that of the glossiness.

The CPU 101 calculates the evaluation value by obtaining the data with respect to the glossiness in the neighborhood of the boundary in the area in which the glossiness is intended to be adjusted and then by using the weighted average method. The CPU 101 calculates an evaluation value B1 when the transparent toner is applied in the area B and stores the calculated evaluation value B1 in the RAM. Similarly, the CPU 101 calculates an evaluation value B2 when the transparent toner is not applied in the area B and stores the calculated evaluation value B2 in the RAM.

B504 is a step for evaluating the glossiness data converted from the density data at each pixel corresponding to the area (the area C in FIG. 19(*a*)) except for the area in which the glossiness is intended to be adjusted.

The CPU 101 calculates the evaluation value by obtaining the data with respect to the glossiness in the neighborhood of the boundary in the area (the area C) in FIG. 19(*a*) except for the area in which the glossiness is intended to be adjusted and then by using the weighted average method. The CPU 101 calculates an evaluation value C1 when the transparent toner is applied in the area C and stores the calculated evaluation value C1 in the RAM. Similarly, the CPU 101 calculates an evaluation value C2 when the transparent toner is not applied in the area C and stores the calculated evaluation value C2 in the RAM.

S505 is a step for changing the processing depending on the mode, in which the glossiness in the area, obtained in the step S501 is adjusted. The CPU 101 performs a step S506 in the case where the mode obtained in the step S501 is the "GLOSS UP MODE". Further, the CPU 101 performs a step S507 in the case where the mode obtained in the step S501 is the "GLOSS DOWN MODE".

S506 is a step for determining the transparent image data for increasing the glossiness in the area in which the glossiness is intended to be adjusted (the area B in FIG. 19(*a*)) by using the evaluation values calculated in the steps S503 and S504 ("GLOSS UP MODE" selection).

The CPU 101 obtains the evaluation values B1 and B2 calculated in the step S503 and obtains the evaluation values C1 and C2 calculated in the step S504. Then, the CPU 101 compares a value of "C1-B2" with a value of "C2-B1". When the value of "C2-B1" is larger than the value of "C1-B2", the CPU 101 performs the processing in a step S508. When the value of "C1-B2" is larger than the value of "C2-B1", the CPU 101 performs the processing in a step S509.

S507 is a step for determining the transparent image data for decreasing the glossiness in the area in which the glossiness is intended to be adjusted (the area B in FIG. 19(*a*)) by using the evaluation values calculated in the steps S503 and S504 ("GLOSS DOWN MODE" selection).

The CPU 101 obtains the evaluation values B1 and B2 calculated in the step S503 and obtains the evaluation values C1 and C2 calculated in the step S504. Then, the CPU 101 compares a value of "C1-B2" with a value of "C2-B1". When the value of "C2-B1" is larger than the value of "C1-B2", the CPU 101 performs the processing in a step S508. When the value of "C1-B2" is larger than the value of "C2-B1", the CPU 101 performs the processing in a step S509.

In a step S508, the CPU 101 as the image data generating means performs transparent image data generating processing. The CPU 101 generates the transparent image data for forming the transparent image in the image formable area except for the area obtained in the step S501.

In a step S509, the CPU 101 as the image data generating means performs the transparent image data generating processing. The CPU 101 generates the transparent image data for forming the transparent image in the area obtained in the step S501.

The CPU 101 sends the transparent image data generated in the step S508 or S509 to the transparent image forming station T. Then, the transparent image forming station T forms the transparent image on the sheet on which the color image has been fixed. Thereafter, the transparent toner image formed on the sheet is fixed on the sheet by the fixing device 20. As a result, it is possible to obtain a print increased or decreased in glossiness in the area in which the glossiness is intended to be adjusted, designated by the user in accordance with the mode selected.

As described above, by employing the constitution in this embodiment, not depending on the density distribution of the color image formed on the sheet, it is possible to increase the glossiness in the area designated by the user irrespective of the density of the color image.

(Case where Glossiness Difference is Increased and Decreased)

Figure 22:
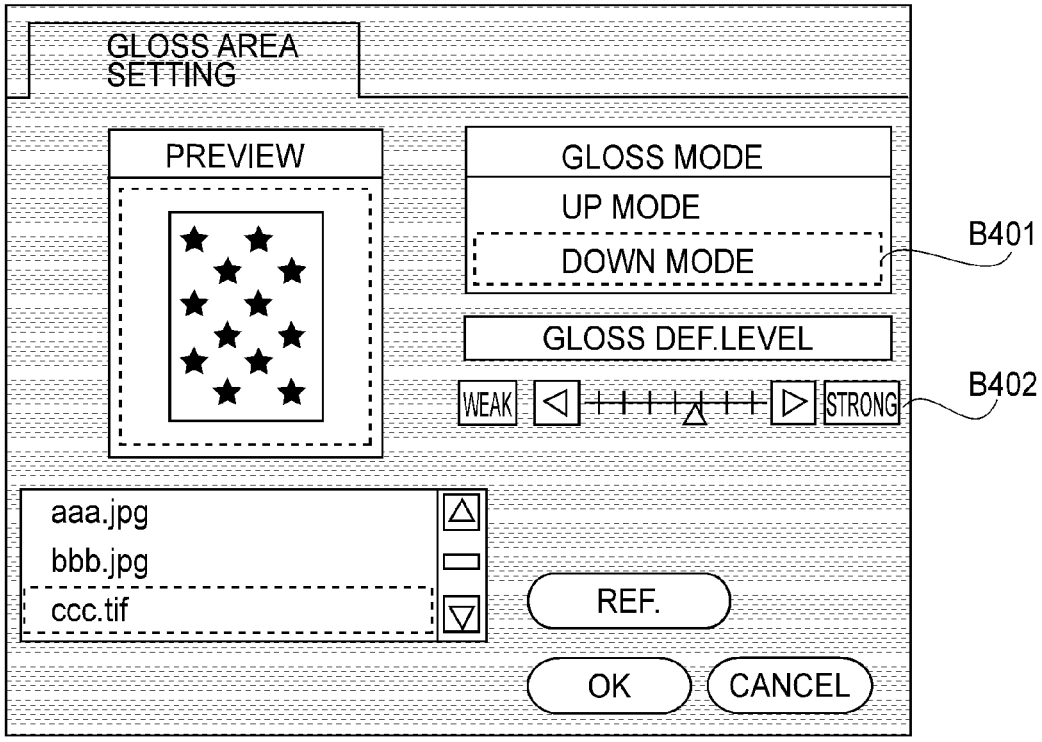
FIG. 22 is a schematic view showing another example of the screen displayed on the display of the MFP in further embodiment of the present invention.

Some users wish to increase the glossiness difference, whereas some users wish to decrease the glossiness difference. For that reason, an example in which the glossiness difference is adjustable on a screen as shown in FIG. 22 will be described. FIG. 22 shows the screen on which the magnitude of the glossiness difference can be changed. In this embodiment, the magnitude of the glossiness difference is changed by the toner amount.

(Change in Toner Amount)

FIG. 22 is the screen for setting the magnitude of the glossiness difference and the mode. The screen shown in FIG. 22 is displayed at the display 111 of the MFP 100. In FIG. 22, B401 represents a portion at which the mode is designated. By adjusting the portion B401, it is possible to designate that the glossiness at the marked portion (★ portion) is made relatively higher or relatively lower than the glossiness at the adjacent portion. B402 represents a slider bar for setting the magnitude of the glossiness difference (level). In the case where the user wishes to increase the glossiness difference, the user sets the cursor so as to approach "STRONG". Further, in the case where the user wishes to decrease the glossiness difference, the user sets the cursor so as to approach "weak". As a result, the user can finely set the level of the glossiness in the area in which the user wishes the adjust the glossiness. The CPU 101 changes the density for the transparent image data depending on the information indicating the magnitude of the set glossiness difference.

(Diversity in Manner of Placing Transparent Toner)

Figure 23:
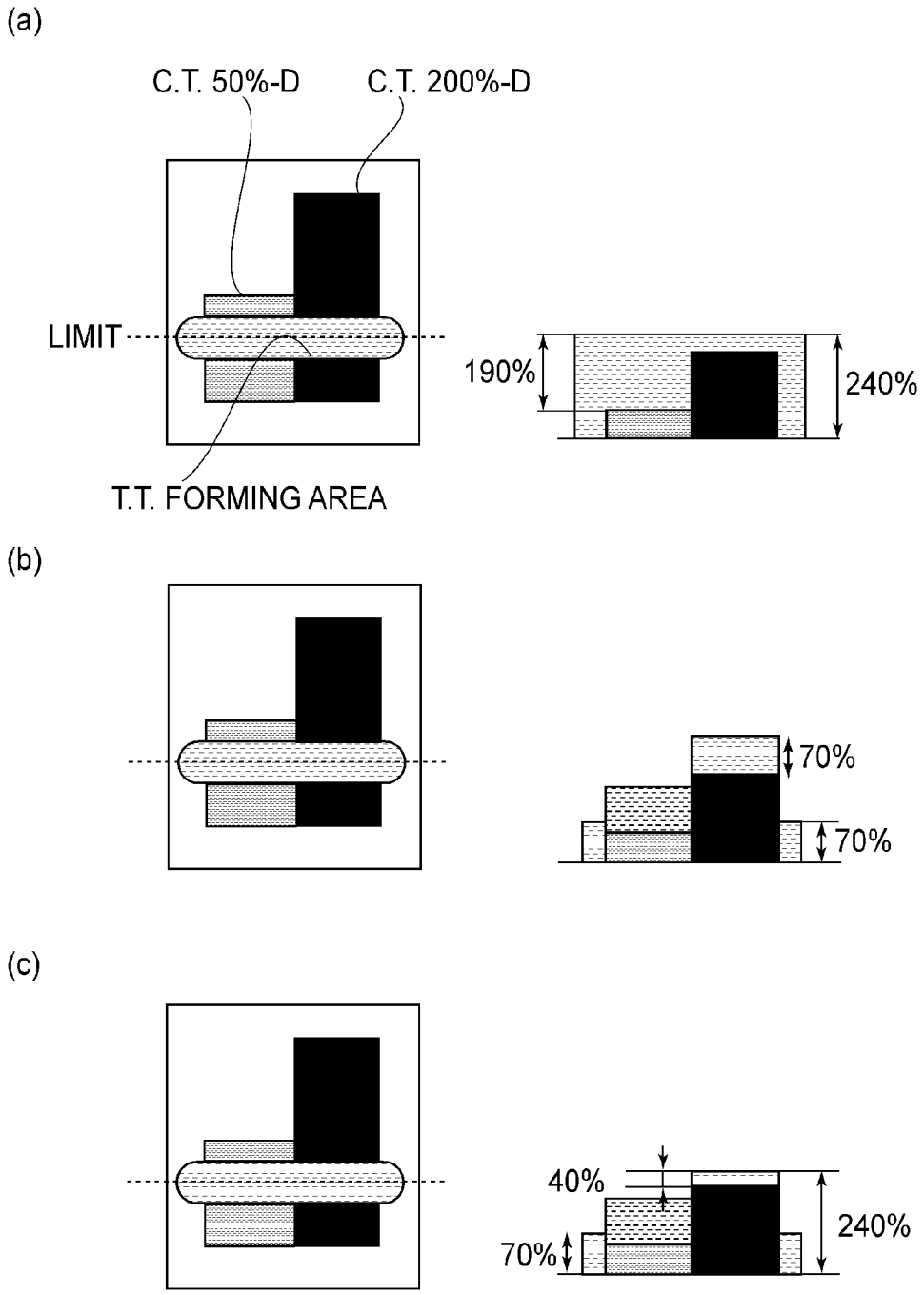
FIGS. 23(*a*), 23(*b*) and 23(*c*) are schematic views each for illustrating an image to be processed by and a print to be output by the image forming apparatus in the further embodiment of the present invention.

In Embodiments 1 and 2, the examples in which the image forming apparatus forms the transparent toner image uniformly on the sheet with the constant density are described. The amount of the transparent toner is not limited to the case where the transparent toner image is formed uniformly with the constant density. Some examples regarding the manner of placing the transparent toner will be described below. FIGS. 23(*a*), 23(*b*) and 23(*c*) are schematic views each showing an image including the transparent toner placed in a manner. In the image shown in FIG. 23(*a*), an upper limit of a total of the amount of the transparent toner and the amount of the color toner is provided. In this example, the upper limit of the density is 240%. In this case, the density of the transparent image formed so as to cover the portion of the color image with 50%-density is 190%. That is, when the color image density is X % and the upper limit density is Y %, the density of the transparent image formed on the sheet is Y-X (%).

FIG. 23(*b*) is the schematic view showing the image of the output product described in Embodiment 1 and Embodiment 2. The density of the transparent image formed on the sheet is constant (70%) irrespective of the color image density.

Also in the image shown in FIG. 23(*c*), the upper limit (240%) of the total of the transparent toner amount and the color toner amount is provided. Similarly as in the case of FIG. 23(*a*), the transparent toner is formed uniformly with the constant density (70%). For example, in the area in which the color image density is 50%, the transparent toner image is formed with the density of 70%. However, in the case where the color image density is high, e.g., 200%, when the transparent toner is placed with the density of 70% in this area, the resultant density exceeds the upper limit (240%). Therefore, the transparent image density is changed to 40%. That is, in the case where the transparent image is formed uniformly with the density of Z %, when the sum of the densities Z % (transparent image density) and X % (color image density) exceeds Y % (upper limit density), the transparent image is formed with (Y−X) %-density (upper limit density−color image print). Incidentally, the above-described transparent toner placing manner is merely some examples and other placing manners may also be employed.

As shown in FIGS. 23(*a*) and 23(*c*), in the case where the upper limit of the total of the transparent toner amount and the color toner amount is provided, when the color image density is 240%, the glossiness cannot be adjusted by placing the transparent toner. For that reason, a method of decreasing the color toner amount (density) is employed by using a method such as UCR (Under Color Removal) or GCR (Gray Component Replacement).

When a color original is subjected to four-color separation, a gray component generates at a portion where three color components of C (cyan), M (magenta) and Y (yellow) overlap with each other. In the UCR, the gray component is replaced with a black (Bk) component. The UCR is used for decreasing a total amount of image data by replacing the gray component having a certain density level or more with the block component.

In a color separation image, dots having the same ratio among C (cyan), M (magenta) and Y (yellow) are black or gray. By replacing the portion with K (black), the ratio of the dots can be reduced, so that a total dot area ratio is lowered by the GCR.

As a result, even in the case where the color image density is high, it is possible to adjust the glossiness by using the transparent toner.

Embodiment 4

(Image Forming System Constitution)

In Embodiments 1, 2 and 3, the control portion for generating the transparent image data is described as the CPU 101 present inside the MFP as the image forming system. However, the image forming system is not limited to the MFP. Other examples of the image forming system will be described below.

(Image Forming System Constitution)

In Embodiments 1, 2 and 3, the control means for generating the transparent image data is described as the CPU 101 present inside the MFP as the image forming system. Further, the control device is described as the controller portion including the CPU 101 as the control means. However, the image forming system is not limited to the MFP. Other examples of the image forming system will be described below.

(Example of Image Forming System)

Figure 24:
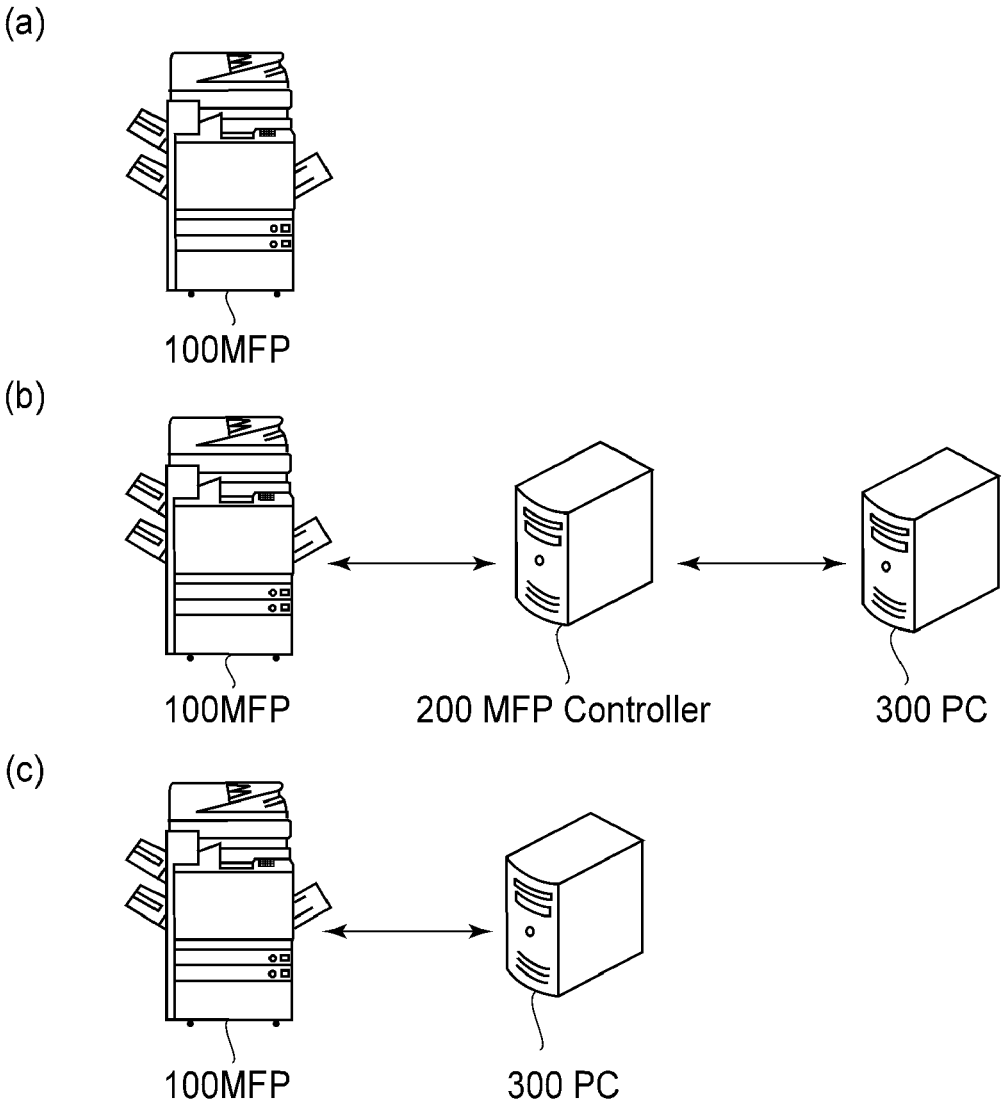
FIGS. 24(*a*), 24(*b*) and 24(*c*) are schematic views each showing an example of a constitution of an image forming system in a still further embodiment of the present invention.

FIGS. 24(*a*) to 24(*c*) are schematic views each showing a constitution example of the image forming system. The image forming system shown in FIG. 24(*a*) is constituted by the MFP 100 alone (to which Embodiments 1, 2 and 3 corresponding). However, the image forming system constitution may also be, constitutions as shown in FIGS. 24(*b*) and 24(*c*).

The image forming system shown in FIG. 24(*b*) is constituted by the MFP 100, the MFP controller 200, and the PC 300. The image forming system shown in FIG. 24(*c*) is constituted by the MFP 100 and the PC 300. Hardware configurations of, as the control device, the PC 300 and the MFP controller 200 will be described.

The PC 300 constituting the image forming system is an example of an external terminal capable of sending print instructions to the MFP 100. For that purpose, it is also possible to use other terminals capable of sending the print instructions to the MFP 100 as an alternative to the PC. For example, it is possible to use portable information terminals such as a WS (work station) and a PDA (personal digital assistant) as the alternative to the PC.

In Embodiments 1 and 2, the color image and the transparent image were formed on the sheet by using the image forming apparatus shown in FIG. 2. However, it is also possible to the image forming apparatus as shown in FIG. 13 including the color image forming stations as the color image forming means and including the transparent image forming station as the transparent image forming means.

In the constitution shown in FIG. 13, the MFP transfers and fixes the color toner image on the sheet. Thereafter, the sheet on which the color toner image is fixed is conveyed again to the secondary transfer portion by the flapper. The transparent toner image is transferred so as to cover the color toner image on the sheet conveyed to the secondary transfer portion. Here, the fixing device as the first fixing means for fixing the color toner image on the sheet is the fixing device 10. Further, the fixing device as the second fixing means for fixing the transparent toner image on the sheet is the fixing device 20. That is, in the MFP shown in FIG. 13, the first fixing means and the second fixing means have the same constitution. Incidentally, the constitution of the image forming apparatus is not limited to that in this embodiment so long as the transparent toner image is formed on the sheet on which the color image toner is fixed so as to cover the color toner image.

For example, in the MFP shown in FIG. 13, the transparent toner image may also be formed and fixed on the sheet on which the color image is fixed in the following manner. First, in the image forming apparatus, the color image is formed and fixed on the sheet. The sheet on which the color image is fixed is discharged to the outside of the image forming apparatus. Instructions to place the discharged sheet, on which the color image has been formed, on the manual feeding tray are provided to the user. Then, the transparent image is formed and fixed on the sheet placed on the manual feeding tray. By controlling the image forming apparatus in this way, it is possible to form and fix the transparent image so as to cover the color image fixed on the sheet.

(Hardware Configuration of PC)

Figure 26:
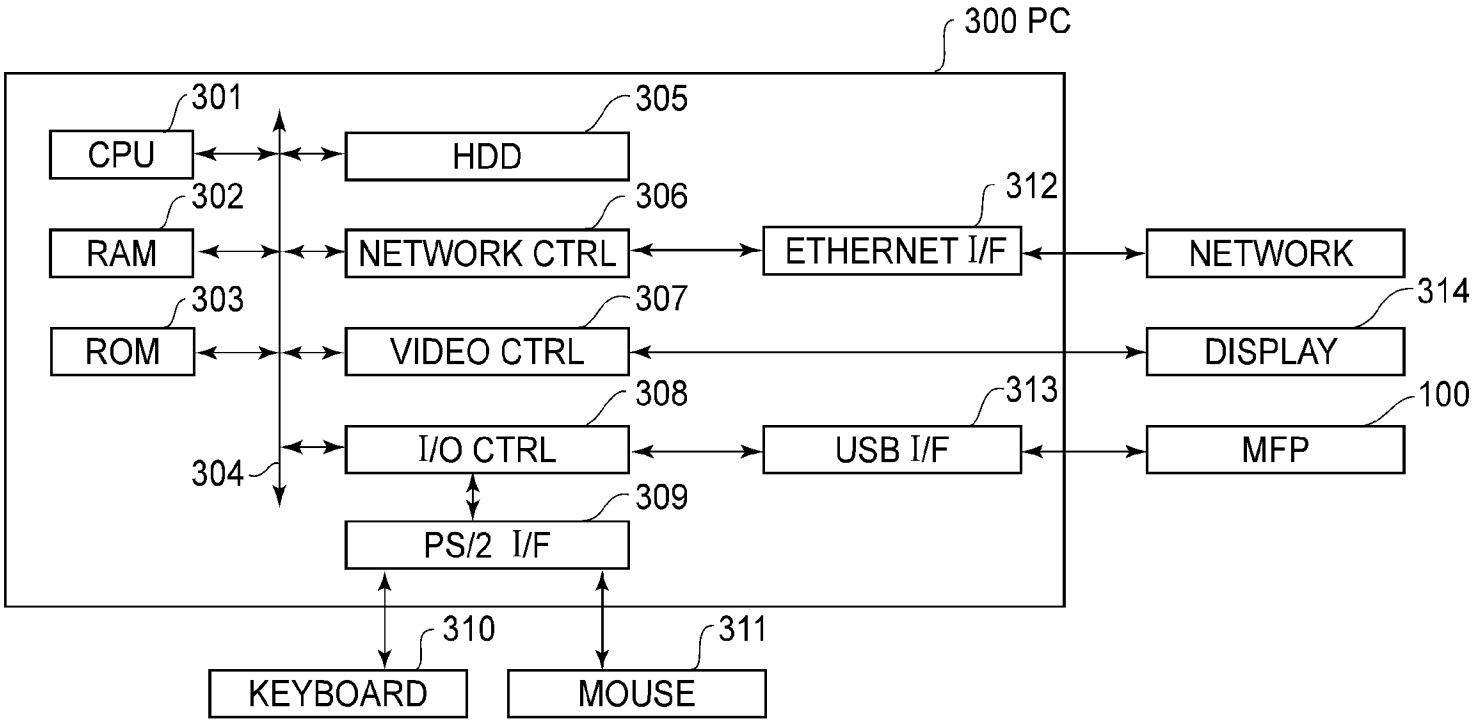
FIG. 26 is a block diagram showing a schematic constitution of a PC (personal computer).

FIG. 26 is a block diagram showing the hardware configuration of the PC 300 as an example of the PC. The hardware configuration of the PC 300 will be described.

A CPU 301, an RAM 302, and an ROM 303 are connected to a bus 304. Similarly, a HDD 305, a network controller 306, a video controller 307, and an I/O controller 308 are connected to the bus 304. The various units connected to the bus 304 are communicatable with each other through the bus 304. The CPU 301 executes a program, e.g., stored in the ROM 303 by expanding the program in the RAM 302. The ROM 303 stores the program executed by the CPU 301. The RAM 302 is used when the CPU 301 executes the program. Further, the CPU 301 sends control instructions and the like to the HDD 305, the network controller 306, the video controller 307, and the I/O controller 308 through the bus 304. Further, the CPU 301 receives signals for indicating states or data such as image data from the HDD 305, the network controller 306, the video controller 307, and the I/O controller 308 through the bus 304. Thus, the CPU 301 is capable of controlling the various units constituting the PC 300.

The HDD 305 stores various files used in the PC 300. The network controller 306 is a dedicated circuit for communicating with external equipment. The network controller 306 modifies and converts the signals sent from the CPU 301 into multi-valued signals in accordance with the IEEE 803.2 standard and sends the signals to the network through an ethernet I/F 312. Further, the network controller 306 demodulates the multi-valued signals received from the network through the ethernet I/F 312 and sends the demodulated signals to the CPU 301. In this case, a communication path through which the PC 300 communicates with the MFP 100 or the MFP controller 200 is not limited to that in a LAN (local area network) but may also be that through the Internet.

Further, the I/O controller 308 converts the signals sent from the CPU 301 into signals in accordance with standards for the respective interfaces and sends the converted signals to a device connected with an USB I/F 313 or a PS (personal system)/2 I/F 309. Conversely, the I/O controller 308 converts the signals received from the USB I/F 313 or the PS/2 I/F 309 and sends the converted signals to the CPU 301. As a result, the PC 300 and the MFP 100 can communicate with each other through the USB I/F 313. Further, the PC 300 obtains an input signal from a keyboard 310 and a mouse 311 as an input device through the PS/2 I/F 309.

The video controller 307 converts the image data into a signal for a screen displayable at a display 314 in accordance with image display instructions received from the CPU 301. As a result, the CPU 301 can display the screen at the display 314.

In this embodiment, the CPU 301 controls various pieces of hardware constituting the PC in accordance with an OS (operating system). As a result, the user can cause the PC to execute a desired operation by manipulating a GUI (graphical user interface) without concern for the hardware constituting the PC. Further, the user is capable of sending the print instructions from an application program, which is running under the OS, to the external MFP. When the print instructions are sent to the MFP, a control method varies depending on the kind of the MFP. For that reason, the PC produces control instructions depending on the MFP by using a driver program corresponding to the kind of the MFP. The driver program is capable of producing the control instructions depending on the connected peripheral equipment by being incorporated in the OS. The explanation on the example of the hardware configuration of the PC in this embodiment is as described above.

(Hardware Configuration of MFP Controller)

Figure 25:
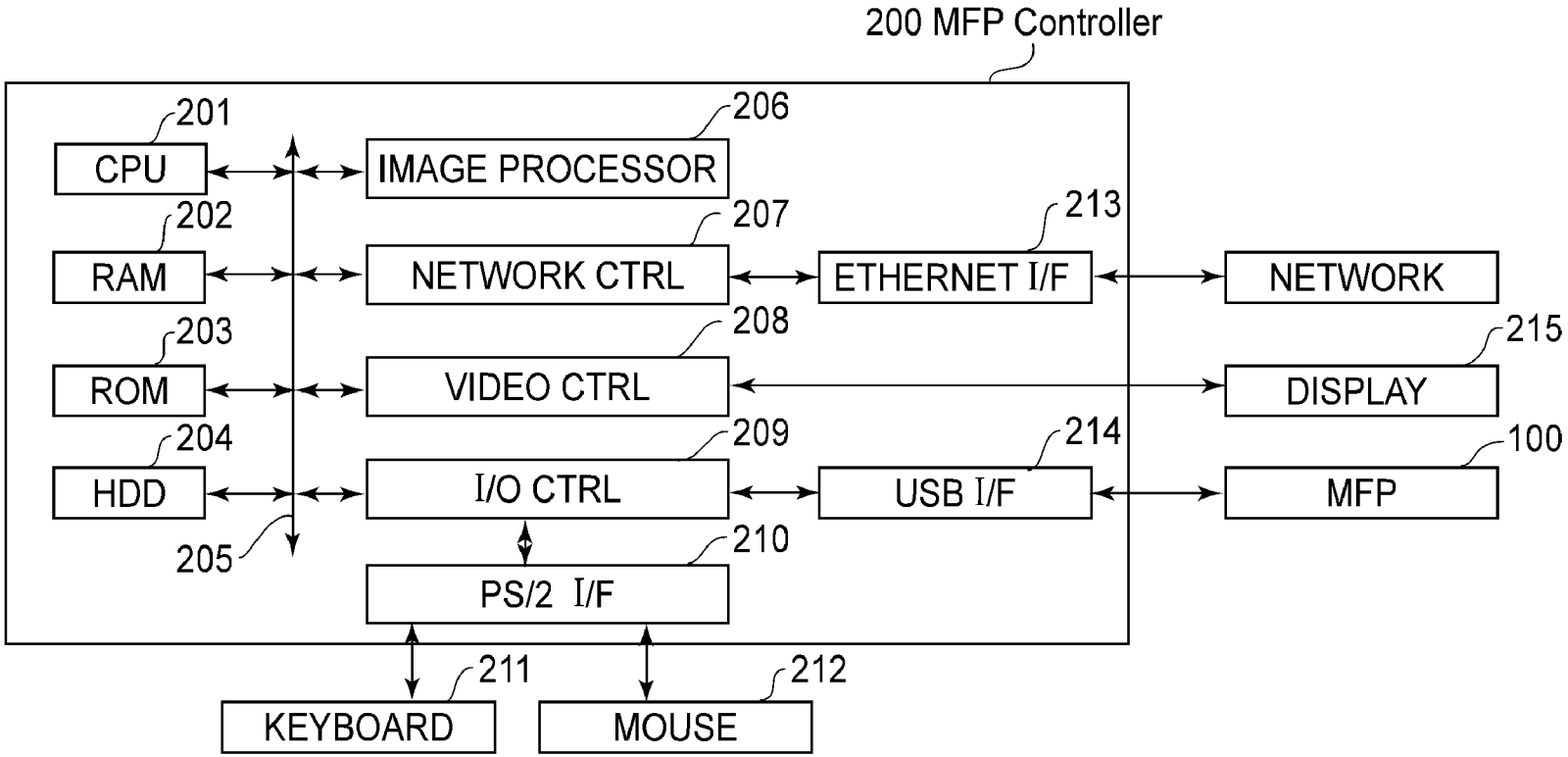
FIG. 25 is a block diagram showing a schematic constitution of an MFP Controller.

FIG. 25 is a block diagram showing the hardware configuration of the MFP controller 200 capable of converting the PDL into the image data. An example of the hardware configuration of the MFP controller 200 will be described.

The MFP controller 200 constituting the image forming system converts the PDL received from the PC 300 into the image data used for the printing by the MFP 100. The processing for converting the PDL into the image data is referred to as the RIP.

A CPU 201, an RAM 202, and an ROM 203, and a dedicated image processing circuit are connected to a bus 205. Similarly, a HDD 204, a network controller 207, a video controller 208, and an I/O controller 209 are connected to the bus 205. The CPU 201 executes a program, e.g., stored in the ROM 203 by expanding the program in the RAM 202. Further, the CPU 201 sends control instructions and the like to the HDD 204, the network controller 207, the video controller 208, and the I/O controller 209 through the bus 205. Further, the CPU 201 receives signals for indicating states and data such as image data from the HDD 204, the network controller 207, the video controller 208, and the I/O controller 209 through the bus 205. Thus, the CPU 201 is capable of controlling the various units constituting the MFP controller 200.

MFP controller 200 is connected with the PC 300 through an ethernet I/F 213. The MFP controller 200 is connected with the MFP 100 through the ethernet I/F 213. The network controller 207 modifies and converts the signals sent from the CPU 201 into multi-valued signals in accordance with the IEEE 803.2 standard and sends the signals to the network through an ethernet I/F 213. Further, the network controller 207 demodulates the multi-valued signals received from the network through the ethernet I/F 213 and sends the demodulated signals to the CPU 201.

Further, the I/O controller 209 converts the signals sent from the CPU 201 into signals in accordance with standards for the respective interfaces and sends the converted signals to a device connected with an USB I/F 214 or a PS (personal system)/2 I/F 210. Further, the I/O controller 209 converts the signals received from the USB I/F 214 or the PS/2 I/F 210 and sends the converted signals to the CPU 201. As a result, the MFP controller 200 and the MFP 100 can communicate with each other through the USB I/F 214. Further, the MFP controller 200 obtains an input signal from a keyboard 211 and a mouse 212 as an input device through the PS/2 I/F 210.

The video controller 208 converts the image data into a signal for a screen displayable at a display 215 in accordance with image display instructions received from the CPU 201 and sends the converted signal to the display 215. As a result, the CPU 201 can display the screen at the display 215.

The MFP controller 200 receives the PDL sent from the PC 300 and subjects the described PDL to the RIP. Arithmetical operation instructions during the RIP include uniform iteration process. For that reason, in many cases, a shorter execution time is required for processing by a hardware optimized for processing image processing instructions rather than execution of all the arithmetical operation instructions by the CPU 201. For that reason, the MFP controller executes the RIP by sharing the processing between the CPU 201 and the dedicated image processing circuit 206. The RIP may also be performed by the CPU 201 alone. The dedicated image processing circuit 206 is constituted by an ASIC (application specific integrate circuit). The dedicated image processing circuit 206 may also be constituted by mounting a reconfigurable hardware (e.g., a PLD (programmable logic device)). The thus-converted image data by the CPU 201 and the dedicated image processing circuit 206 is sent to the MFP 100.

In this embodiment, preparation of the image data is carried out by the MFP controller 200 but may also be carried out by the MFP 100.

The explanation on the hardware configuration of the MFP controller in this embodiment is as described above.

(Control Processing in Each Image Forming System)

In Embodiments 1 and 2, the image forming system is constituted by a plurality of devices such as the MFP, the MFP controller, and the PC. In Embodiment 1, the control of the image forming apparatus was carried out by the CPU 101 of the MFP 100 along the flow chart. That is, in the case where the image forming system is constituted by the MFP 100 alone as shown in FIG. 24(*a*), the control processing was carried out by the CPU 101 in the MFP 100. However, as shown in FIG. 24(*b*), the image forming system is constituted by the MFP 100, the MFP controller 200, and the PC 300, there is no need to execute the control processing by the CPU 101 of the MFP 100. For example, the CPU 201 of the MFP controller 200 can execute the control processing, so that the glossiness in the area in which the user wishes to decrease the glossiness can be decreased. Further, in FIG. 24(*c*), the image forming system is constituted by the MFP 100 and the PC 300. In this case, e.g., the CPU 301 of the PC 300 may execute the control processing, so that the glossiness in the area in which the user wishes to decrease the glossiness can be decreased. (Shared execution of control processing in systematized device)

As described above, in the system consisting of the plurality of device, there is no need to execute the control processing by the CPU 101 of the MFP 100. Further, there is also no need to execute the control processing always by the CPU of a single device. That is, the plurality of CPUs present in the plurality of devices may also execute the control processing in a shared manner. That is, the respective steps of the flow charts shown in FIGS. 6, 10, 12, 16 and 21 which are characteristic processings described in Embodiment 1 and Embodiment 2 may also be executed in the shared manner.

For example, when the image forming system has the constitution shown in FIG. 24(*c*), the obtaining of the area in which the glossiness is intended to be decreased may be performed by the CPU 301 of the PC 300 and the obtaining of the information corresponding to the glossiness of the sheet on which the image is to be formed may be performed by the CPU 101 of the MFP 100. Thus, the characteristic processing may be executed by a single information processing apparatus or an information processing system including a plurality of information processing apparatuses.

Further, the program for executing the characteristic processing may also be supplied from a remote device to the information processing system or the information processing apparatus. Further, the information processing apparatus included in the information processing system may read and execute program code stored in an external information processing apparatus.

That is, the program itself to be installed in the information processing apparatus is used for realizing the above-described processing. The form of the program is not limited so long as the information processing apparatus can execute the above-described processing by using the program.

As a recording medium for supplying the program, e.g., it is possible to use a flexible disk, a hard disk, an optical disk, a magneto-optical disk, a CD-ROM (compact-disk read-only memory), a CD-R (compact disk-recordable), a CD-RW (compact disk-rewritable), and the like. Further, as the recording medium, it is also possible to use a magnetic tape, a non-volatile memory card, an ROM, a DVD (digital versatile disk) (DVD-ROM or DVR-R (recordable)), and the like.

Further, in the MFP 100, the program may also be downloaded from the network through the ethernet I/F 114. Further, in the MFP controller 200 and the PC 300, the program may also be downloaded from a homepage (web site) on the Internet by using a browser. That is, from the homepage, the program itself or a program file which is compressed and has an auto-install function is downloaded into the recording medium such as the hard disk. Further, it is also possible to obtain the program by dividing a program constituting the program for executing the above-described processing into a plurality of files and by downloading the divided files from different homepages, respectively. That is, there is a possibility that a WWW (world wide web) server capable of downloading a program file with respect to a plurality of users constitutes a constituent feature.

Further, the program file may also be distributed to the users by being encrypted and then being stored in a storage medium such as the CD-ROM. In this case, it is also possible to permit only a user who fulfils a predetermined requirement (condition) to download key information for decrypting the encrypted program, execute the decryption of the encrypted program with the key information, and install the program into the information processing apparatus.

Incidentally, on the basis of instructions from the program, the OS running on the information processing apparatus may also execute a part or all of actual processing.

Further, the program read from the recording medium may also be written (stored) in a memory provided to a function expanding board inserted into the information processing apparatus or a function extending unit connected to the information processing apparatus. On the basis of the instructions, a CPU provided in the function expanding board or the function extending unit may also execute a part or all of the actual processing.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 020223/2009 filed Jan. 30, 2009, which is hereby incorporated by reference.

What is claimed is:

1. A control apparatus for controlling an image forming system capable of forming a transparent image for adjusting glossiness of a color image to be formed on a sheet by using a transparent toner, said control apparatus comprising:

area obtaining means for obtaining a first area of the color image in which glossiness is to be adjusted;

mode obtaining means for obtaining a mode selected from a plurality of modes including a mode in which the glossiness in the first area obtained by said area obtaining means is higher than that in a second area of the color image and including a mode in which the glossiness in the first area is lower than that in the second area; and control means for controlling, depending on the mode obtained by said mode obtaining means, an area in which the image forming system forms the transparent image in a switchable manner between the first area and the second area.

2. An apparatus according to claim 1, further comprising sheet information obtaining means for obtaining information corresponding to the glossiness of the sheet on which the image is to be formed, wherein said control means switches, on the basis of the information obtained by said information obtaining means, the area in which the image forming system forms the transparent image between the first area and the second area.

3. An apparatus according to claim 2, further comprising image data obtaining means for obtaining color image data corresponding to the color image to be formed on the sheet, wherein said control means switches, on the basis of the color image data obtained by said image data obtaining means, the area in which the image forming system forms the transparent image between the first area and the second area.

4. An apparatus according to claim 3, wherein, in the case where the mode obtained by said mode obtaining means is a mode in which the glossiness in the first area obtained by said area obtaining means is higher than that in the second area, when a density of the color image to be formed on the sheet is a predetermined threshold or more on the basis of the color image data and information corresponding to the sheet is a predetermined threshold or more, or when the density of the color image to be formed on the sheet is less than the predetermined threshold and the information corresponding to the sheet is the predetermined threshold or more, said control means controls, on the basis of the color image data, the image forming system such that the transparent image is selectively formed and fixed in the second area to cover a part of the sheet on which the color image has been formed, and when the density of the color image to be formed on the sheet is less than the predetermined threshold and the information corresponding to the sheet is less than the predetermined threshold, said control means controls, on the basis of the color image data, the image forming system such that the transparent image is selectively formed and fixed in the first area to cover a part of the sheet on which the color image has been formed.

5. An apparatus according to claim 3, wherein, in the case where the mode obtained by said mode obtaining means is a mode in which the glossiness in the first area obtained by said area obtaining means is lower than that in the second area, when a density of the color image to be formed on the sheet is a predetermined threshold or more on the basis of the color image data and information corresponding to the sheet is a predetermined threshold or more, or when the density of the color image to be formed on the sheet is less than the predetermined threshold and the information corresponding to the sheet is the predetermined threshold or more, said control means controls, on the basis of the color image data, the image forming system such that the transparent image is selectively formed and fixed in the first area to cover a part of the sheet on which the color image has been formed, and when the density of the color image to be formed on the sheet is less than the predetermined threshold and the information corresponding to the sheet is less than the predetermined threshold, said control means controls, on the basis of the color image data, the image forming system such that the transparent image is selectively formed and fixed in the second area to cover a part of the sheet on which the color image has been formed.

6. An image forming system comprising:

color image forming means for forming a color image on a sheet;

transparent image forming means for forming a transparent image on the sheet;

fixing means for fixing the images formed on the sheet; and a control apparatus according to claim 1.

7. A control apparatus for controlling an image forming system for forming a transparent image with a transparent toner on at least a part of a sheet on which an image is to be formed, said control apparatus comprising:

area obtaining means for obtaining a first area of the image in which glossiness is to be adjusted;

mode obtaining means for obtaining a mode selected from a plurality of modes including a mode in which the glossiness in the first area obtained by said area obtaining means is increased and including a mode in which the glossiness in the area obtained by said area obtaining means is decreased; and control means for controlling, depending on the mode obtained by said mode obtaining means, an area in which the image forming system forms the transparent image in a switchable manner between the first area and a second area of the color image which is different from the first area.

* * * * *